US008925145B2

(12) United States Patent
Wilson

(10) Patent No.: US 8,925,145 B2
(45) Date of Patent: Jan. 6, 2015

(54) CLEANING APPLIANCE

(71) Applicant: Dyson Technology Limited, Wiltshire (GB)

(72) Inventor: Hugo George Wilson, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 14/084,985

(22) Filed: Nov. 20, 2013

(65) Prior Publication Data

US 2014/0137363 A1 May 22, 2014

(30) Foreign Application Priority Data

Nov. 20, 2012 (GB) ..... 1220884.9

(51) Int. Cl.

| | |
|---|---|
| ***A47L 9/20*** | (2006.01) |
| ***A47L 9/10*** | (2006.01) |
| ***A47L 5/24*** | (2006.01) |
| ***A47L 9/16*** | (2006.01) |

(52) U.S. Cl.

CPC . *A47L 9/106* (2013.01); *A47L 5/24* (2013.01); *A47L 9/1625* (2013.01); *A47L 9/1641* (2013.01); *A47L 9/1683* (2013.01)

USPC ..... 15/347; 15/352; 55/429; 55/433

(58) Field of Classification Search

USPC ..... 15/347, 352; 55/429, 433, DIG. 3

IPC ..... A47L 9/20

See application file for complete search history.

(56) References Cited

U.S. PATENT DOCUMENTS

| | | | |
|---|---|---|---|
| 2005/0132530 | A1 | 6/2005 | Macleod et al. |
| 2006/0156508 | A1 | 7/2006 | Khalil |

FOREIGN PATENT DOCUMENTS

| | | |
|---|---|---|
| EP | 2 040 599 | 4/2009 |
| GB | 2 035 787 | 6/1980 |
| WO | WO-2008/009891 | 1/2008 |
| WO | WO-2010/061211 | 6/2010 |

OTHER PUBLICATIONS

Search Report dated Mar. 18, 2013, directed to GB Application No. 1220884.9; 1 page.

International Search Report and Written Opinion mailed Feb. 18, 2014, directed to International Application No. PCT/GB2013/052995; 14 pages.

*Primary Examiner* — David Redding

(74) *Attorney, Agent, or Firm* — Morrison & Foerster LLP

(57) ABSTRACT

A cleaning appliance comprising a main body and a separating apparatus including a dirt collector having a base that is openable that allows the dirt collector to be emptied. The cleaning appliance includes an actuator that is operable sequentially such that, during a first operation, the actuator causes the base to be opened and, during a second operation, the actuator causes the dirt collector to disengage from the separating apparatus. A single actuator is therefore used for two functions: firstly to open the dirt collector for emptying purposes and, secondly, to disengage the dirt collector from the separating apparatus for example for cleaning purposes. Such an arrangement is space efficient and intuitive for the user.

19 Claims, 27 Drawing Sheets

CLEANING APPLIANCE

REFERENCE TO RELATED APPLICATIONS

This application claims priority of United Kingdom Application No. 1220884.9, filed Nov. 20, 2012, the entire contents of which are incorporated herein by reference.

FIELD OF THE INVENTION

The invention relates to a cleaning appliance including a separating apparatus having a dirt collector which can be emptied and also which is removable from the separating apparatus. The invention has particular utility in handheld and stick-type cleaning appliances, but also is applicable to other types of appliances such as upright and cylinder variants.

BACKGROUND OF THE INVENTION

Handheld vacuum cleaners are well known and have been manufactured and sold by various manufacturers for several years. One such handheld vacuum cleaner is described in EP2040599B, and as marketed by Dyson Limited as model number DC16. A similar vacuum cleaner of the so-called 'stick-vac' type is also marketed by Dyson Limited as model number DC35.

The vacuum cleaner of EP2040599B comprises a main body including a motor and fan unit located on the upper side of a handle and a power source in the form of a battery located on a lower side of the handle. The main body is connected to a cyclonic separator which includes a dirty air inlet through which dirt is drawn into the cyclonic separator when the motor and fan unit in the main body is operated. The cyclonic separator unit functions in the usual way to separate dirt from the air flow following which clean air is discharged from the cyclonic separator, through the motor and fan unit and exhaust from the air vents defined in the main body.

Two significant user-related features of the vacuum cleaner of EP2040599B are the mechanism by which the cyclonic separator is emptied and the way in which the main body and the cyclonic separator are joined.

Referring firstly to the joint between the main body and the cyclonic separator, the main body and the cyclonic separator are releasably connectable to each other at a generally rectangular interface. Part of this interface is defined by the cyclonic separator and the other part of the interface is defined by the main body. The two interface parts are engageable with one another in a type of 'clam shell' arrangement the interface defining an internal chamber within which an air filter is housed.

The main body interface part includes a tab on a lower portion thereof that is receivable in a receptacle on the interface part of the cyclonic separator. The two interface parts are therefore hinged about the tab and receptacle. The upper part of the cyclonic separator includes a user operated latch which engages with a catch defined on the upper part of the main body. In this way, the interface parts of the main body and the cyclonic separator can be brought together, hinged about the lower tab and cooperating receptacle, and secured to one another with the latch. It is a simple operation for a user to release the part by actuating the latch thereby disengaging the upper portion of the interface parts. However, a disadvantage with this arrangement is that there is a degree of 'lateral flex' between the main body and the cyclonic separator which may be noticeable particularly when a significant sideways load is exerted on the dirty air inlet of the cyclonic separator. Flex in a vacuum cleaning device is generally undesirable since it may be perceived by a user as an area of mechanical weakness, or simply an indicator of low quality. Therefore, it is desirable to develop a mechanism which provides a stronger interface between the dust separator and the main body of a handheld vacuum cleaner in particular.

Turning to the mechanism by which the cyclonic separator is emptied, the cyclonic separator has an openable base which is pivoted against the cylindrical wall of the cyclonic separator so that it can swing open. The side of the base opposite the pivot is lockable into a catch. The catch is operated by a user-operated actuator in the form of a slider-button mounted on the main body. The actuator includes a rod which pushes against the base when the actuator is pushed and releases the base so that it is free to swing away from the door. Further, removal of the outer bin of the cyclonic separator is possible, but this requires a user to undo a dedicated catch proximate the lower rim of the bin and physically pull the bin away from the remainder of the cyclonic separator. A more user-friendly mechanism is desired.

SUMMARY OF THE INVENTION

It is against this background that the invention provides, in a first aspect, an apparatus, for example a cleaning apparatus and, more particularly a cleaning appliance such as a vacuum cleaner, comprising a first component that is releasably connected to a second component at an interface, the interface including a first interface portion and a second interface portion, and connecting means including at least one radially interlocking region extending about at least a portion of the interface.

When embodied in a cleaning appliance such a vacuum cleaner, the interface may be between a separating apparatus and a main body of the appliance. In this context the invention provides a improved connection between the two components since they are interlocked radially about the interface.

In one embodiment the connecting means includes a connecting member captive on the first interface portion and operable to lock onto one or more radial catch regions provided on the second interface portion. The connecting member may be a part-circular clip, such as a circlip that is compressible in a radial direction to reduce its outer diameter.

In a particularly advantageous arrangement, the apparatus includes an airflow generator for drawing air into the appliance and through the separating apparatus, wherein an airflow path from the separating apparatus to the main body is defined internally through the interface. Preferably, the first interface portion is associated with the body and the second interface portion is associated with the separating apparatus.

Although the resilient member may be configured so that the two components may be pulled apart under a application of a predetermined force, in one embodiment a tool is required to enable the resilient member to disengage the interface.

Further preferred and/or optional features are provided in the dependent claims.

In a second aspect, the invention provides, a cleaning appliance comprising a main body and a separating apparatus including a dirt collector having a base that is openable to allow the dirt collector to be emptied, wherein the cleaning appliance includes an actuator that is operable sequentially such that, during a first operation, the actuator causes the base to be opened and, during a second operation, the actuator causes the dirt collector to disengage from the separating apparatus.

The invention enables a single user-operable interface to perform two functions: firstly to open the bin door and secondly, when the bin door has been opened, to remove the bin from the separating apparatus. This is particularly useful in the case of a handheld cleaning apparatus when it is generally required to empty the bin when the separating apparatus is attached to the main body. However, in the context of an upright or cyclone type vacuum cleaner, the same actuator could also be used to decouple the separating apparatus from the main body. This sequence of operation therefore provides a simplified user interface because only a single actuator is required to perform two, or even three functions, but it is also a solution which is space efficient and lighter in weight.

Preferred and/or optional features of this aspect of the invention are provided in the dependent claims.

BRIEF DESCRIPTION OF THE DRAWINGS

In order that it may be more readily understood, embodiments of the invention will now be described with reference to the accompanying drawings, in which.

DETAILED DESCRIPTION OF THE INVENTION

Figure 1:
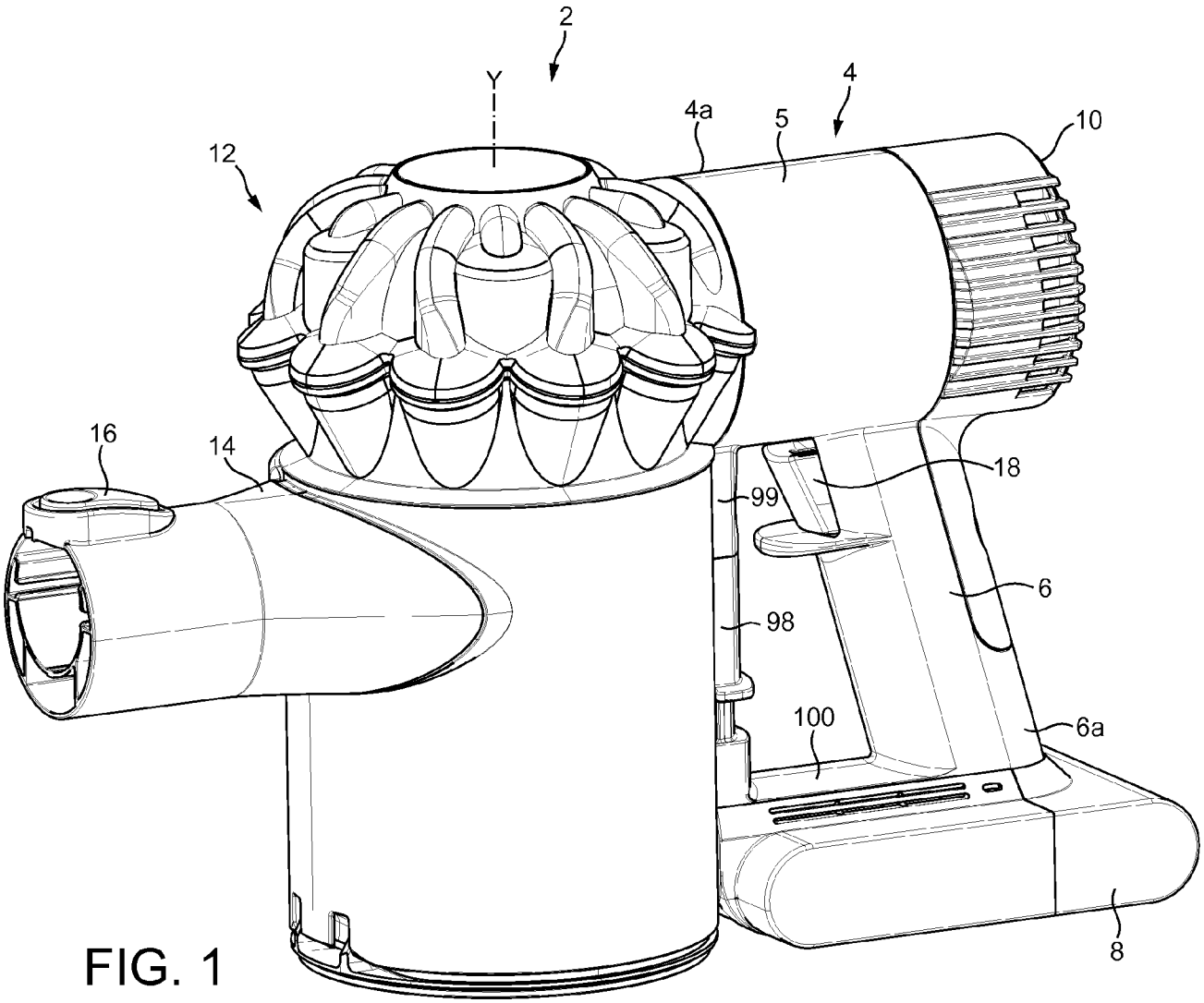
FIG. 1 shows a perspective view of a handheld cleaning appliance according to the invention.
Figure 2A:
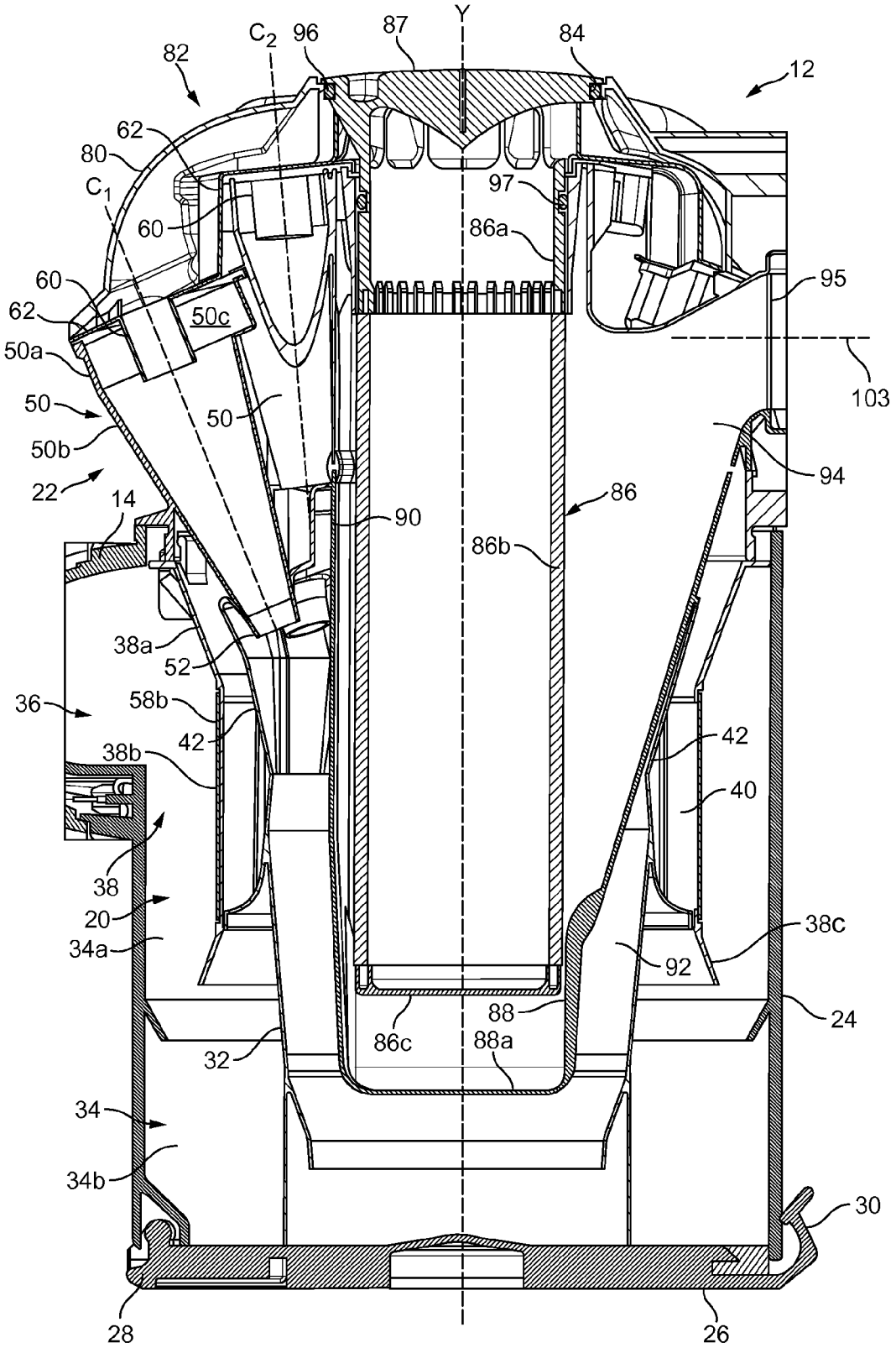
FIG. 2*a* is a section view of the cyclonic separating apparatus of the appliance in FIG. 1.
Figure 2B:
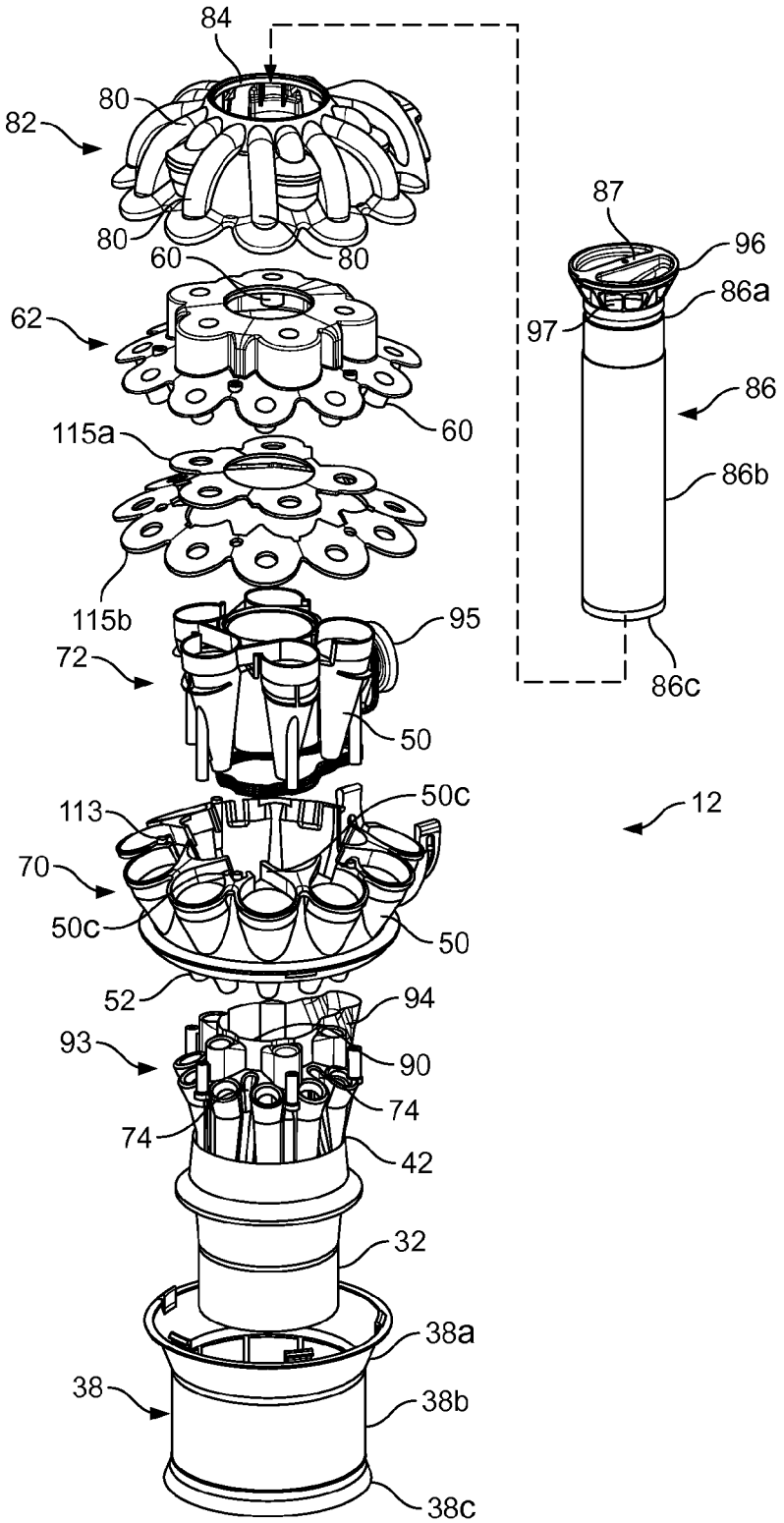
FIG. 2*b* is an exploded view of the internal components of the separating apparatus.

With reference to FIGS. 1 and 2, a handheld vacuum cleaner 2 has a main body 4 which houses an airflow generator 5 in the form of a motor and fan unit above a generally upright handle or grip portion 6. The handle 6 has a lower end 6*a* that supports a generally slab-like battery pack 8. A set of exhaust vents 10 are provided on the main body 4 for exhausting air from the handheld vacuum cleaner 2.

The main body 4 supports a cyclonic separating apparatus 12 that is operable to remove dirt, dust and other debris from a dirt-bearing airflow drawn into the vacuum cleaner by the airflow generator. The cyclonic separator 12 is attached to a forward part 4*a* of the main body 4 and an air inlet nozzle 14 extends from a forward portion of the cyclonic separator that is remote from the main body 4. The air inlet nozzle 14 is configured so that a suitable brush tool can be removably mounted to it and includes a catch 16 for securely holding such a brush tool when the tool is engaged with the inlet. The brush tool is not material to the present invention and so is not shown here. It should also be appreciated that the air inlet nozzle could also be connected to a suitable wand having a cleaning head and, in such a configuration, would take the form of a stick-vac type cleaner. Such a configuration is known in the market, for example the Dyson DC35.

The cyclonic separating apparatus 12 is located between the main body 4 and the air inlet nozzle 14 and so also between the handle 6 and the air inlet nozzle 14. The separating apparatus 12 has a longitudinal axis Y which extends in a generally upright direction so that the handle 6 lies at a shallow angle to the axis Y.

The handle 6 is oriented in a pistol-grip formation which is a comfortable configuration for a user since it reduces stress on a user's wrist during cleaning. The separating apparatus 12 is positioned close to the handle 6 which also reduces the moment applied to the user's wrist when the handheld vacuum cleaner 2 is in use. The handle 6 carries an on/off switch in the form of a trigger 18 for turning the vacuum cleaner motor on and off. In use, the motor and fan unit 5 draws dust laden air into the vacuum cleaner 12 via the air inlet nozzle 14. Dirt and dust particles entrained within the air flow are separated from the air and retained in the separating apparatus 12. The cleaned air is ejected from the rear of the separating apparatus 12 and conveyed by a short duct to the motor and fan unit 5 located within the main body 4, and is subsequently expelled through the air outlets 10.

The separating apparatus 12 forming part of the handheld vacuum cleaner 2 is shown in more detail in FIG. 2 which is a cross section through the separating apparatus 12 along the centreline of the vacuum cleaner. In overview, the separating apparatus 12 comprises a first cyclonic separating unit 20 and a second cyclonic separating unit 22 located downstream from the first cyclonic separating unit 20. A collecting bin 24 of the separating apparatus 12 is defined by an outer wall being substantially cylindrical in shape and which extends about a longitudinal axis Y of the separating apparatus 12.

The lower end of the outer bin 24 is closed by a bin base 26 or 'door' that is pivotably attached to the outer wall 24 on the side opposite from the main body by means of a pivot 28 and held in a closed position by a catch 30, as will described in further detail later. Radially inward of and coaxial with the outer wall 24 is a second cylindrical wall 32 so that a chamber 34 is defined between the two walls. The second cylindrical wall 32 engages and is sealed against the base 26 when it is closed. The upper portion of the annular chamber 34 forms a cylinder-shaped cyclone chamber or, more simply 'cyclone' 34*a*, of the first cyclonic separating unit 20 and the lower portion of the annular chamber 34 forms a dust collecting zone 34*b* of the first cyclonic separating unit 20. Although there is no definite physical demarcation between the cyclone and the dust collecting zone, in general the dust collecting zone is beneath a downwardly angled lip 35 that protrudes radially inwards from the outer wall 24. The lip 35 helps to prevent dirt in the dirt collecting zone being entrained back into the airflow in the cyclone chamber.

A bin inlet 36 is provided at the upper end of the chamber 34 for receiving an air flow from the air inlet nozzle 14. Although not shown in the Figures, the bin inlet 36 is arranged tangentially to the chamber 34 so as to ensure that incoming dirty air is encouraged to follow a helical path around the chamber 34.

A fluid outlet from the chamber 34 is provided in the outer bin in the form of a generally cylindrical shroud 38. More specifically, the shroud 38 has an upper frustoconical wall 38*a* that tapers towards a lower cylindrical wall 38*b* that depends downwardly into the chamber 34. A skirt 38*c* depends from the lower part of the cylindrical wall and tapers outwardly in a direction towards the outer wall 24. The lower wall 38*b* of the shroud is perforated therefore providing the only fluid outlet from the chamber 34. By 'perforations', it is meant that the shroud is formed to be air-permeable for example in the form of a plastic or metal mesh, or a solid wall having a plurality of holes through which air may pass. Currently a plastics mesh is preferred.

Referring also to FIG. 3, a second annular chamber 40 is located behind the shroud 38 and provides a manifold from which airflow passing through the shroud 38 from the first separating unit 20 is fed to the second cyclonic separating unit 22 through channels defined by a centrally positioned cyclone support structure 42. The second cyclonic separating unit 22 comprises a plurality of cyclones 50 arranged fluidically in parallel to receive air from the first cyclonic separating unit 20. In this example, the cyclones 50 are substantially identical in size and shape, and each one comprises a cylindrical portion 50*a* and a tapering portion 50*b* depending downwardly from it (only one cyclone is labelled in FIG. 2 for clarity). The cylindrical portion 50*a* comprises an air inlet 50*c* for receiving fluid from the second annular chamber 40. The tapering portion 50*b* of each cyclone is frusto-conical in shape and terminates in a cone opening 52 at its bottom end through which dust is ejected, in use, into the interior of the cyclone support structure 42. An air outlet in the form of a vortex finder 60 is provided at the upper end of each cyclone 50 to allow air to exit the cyclone. Each vortex finder 60 extends downwardly from a vortex finder member 62.

The cyclones of the second cyclonic separating unit 22 are grouped into a first set of cyclones 70 and a second set of cyclones 72 and, as can be seen in FIGS. 2 and 3, the second, upper, set of cyclones is positioned axially above the first, lower, set of cyclones 70. Although not essential to the invention, in this embodiment the first set of cyclones 70 contains more cyclones (ten in total) than the second set of cyclones 72 (five in total). Each cyclone 50 of both sets has a longitudinal axis C which is inclined downwardly and towards the longitudinal axis Y of the outer wall 52. However, to enable a greater degree of nesting of the second set of cyclones into the first set of cyclones, the longitudinal axes $C_2$ of the second set of cyclones 72 are all inclined at to the longitudinal axis Y of the outer wall at a shallower angle than the longitudinal axes $C_1$ of the first set of cyclones 70.

Circulating air is discharged from the secondary cyclones 50 via the vortex finders 60, and these are defined by a short cylindrical tube that extends downwardly into an upper region of a respective cyclone 50. Each vortex finder 60 leads into a respective vortex finger 80 defined by an exhaust plenum or manifold 82 located at the top of the separating apparatus 12 that serves to direct air from the outlets of the cyclones to a central aperture 84 of the manifold 82. The aperture 84 constitutes the upper opening of a central duct 88 of the separating apparatus into which a filter member 86 is received. In this embodiment, the filter member 86 is an elongate sock filter that extends down into the central duct 88 along the axis Y, the duct 88 being delimited by a third cylindrical wall 90 defined by the cyclone supporting structure 42.

The third cylindrical wall 90 is located radially inwardly of the second cylindrical wall 32 and is spaced from it so as to define a further annular chamber 92 which extends down to the bin base 26. An upper region of the cyclone support structure 42 provides a cyclone mounting arrangement 93 to which the cone openings 52 of the cyclones of the second cyclonic separating 22 are mounted so that they communicate with the interior of the support structure 42. In this way, in use, dust separated by the cyclones 50 of the second cyclonic separating unit 22 is ejected through the cone openings 52 into the chamber 92 where it can collect prior to being emptied. The chamber 92 therefore form a 'fine dust collector' of the second cyclonic separating unit 22 that can be emptied simultaneously with the dust collecting zone of the first cyclonic separating unit 20 when the base 26 is moved to an open position.

During use of the vacuum cleaner, dust laden air enters the separating apparatus 12 via the bin inlet 36. Due to the tangential arrangement of the bin inlet 36, the dust laden air follows a helical path around the outer wall 24. Larger dirt and dust particles are deposited by cyclonic action in the first annular chamber 34 and collect at the bottom of the chamber 34 in the dust collecting bin. The partially-cleaned dust laden air exits the first annular chamber 34 via the air-permeable shroud 38 and enters the second annular chamber 40. The partially-cleaned air then passes into the air channels 74 of the cyclone support structure 42 and is conveyed to the air inlets 50*c* of the first and second sets of cyclones 70, 72. Cyclonic separation is established inside the two sets of cyclones 70, 72 in order to separate the relatively fine dust particles still entrained within the airflow.

The dust particles separated from the airflow by the first and second set of cyclones 70, 72 are deposited in the third annular chamber 92. The further cleaned air then exits the cyclones via the vortex finders 60 and passes into the manifold 82, from which the air enters the sock filter 86 in the central duct 88 and from there passes into an outlet passage 94 of the cyclone separator. As can be seen, the filter 86 comprises an upper mounting portion 86*a* and lower filter portion 86*b* that carries out the filtering function and so is formed from a suitable mesh, foam or fibrous element. The upper mounting portion 86*a* supports the filter portion 86*b* and also serves to mount the filter 86 within the duct 88 by engaging with the aperture 84 of the exhaust manifold 82. The mounting portion 86*a* defines a circular outer rim that carries a sealing member 96, for example in the form of an o-ring, by which means the mounting portion 86*a* is received removably, but securely, within the aperture 84 of the manifold. Although not shown here, it should be appreciated that the filter 86 could also be provided with a locking mechanism if it is desired to more securely hold the filter in position. For example, the filter mounting portion 86*a* could carry a twist-lock fitting formation so that the filter could be twisted in a first direction to lock it into position within the aperture 84, and twisted in the opposite direction to unlock the filter.

The mounting portion 86*a* also includes an annular upper section provided with apertures or windows 97 distributed around its circumference, the windows 97 providing an air-flow path for air to enter the interior of the filter 86. Air therefore flows into the filter 86 in a radial direction through the windows 97, following which the air flows down the interior of the filter 86 and then exits through the cylindrical filter media in a radial direction. After flowing out of the filter 86, the cleaned air then travels up the outlet passage 94 and exhausts the separating apparatus 12 via an exit port 95 located at the rear of the separating unit 12.

Having described the general function of the separating apparatus 12, the skilled reader will appreciate it includes two distinct stages of cyclonic separation. First, the first cyclonic separating unit 12 comprises a single cylindrical cyclone 20 having a relatively large diameter to cause comparatively large particles of dirt and debris to be separated from the air by virtue of the relatively small centrifugal forces. A large proportion of the larger debris will reliably be deposited in the dust collecting zone 34.

Second, the second cyclonic separating unit 22 comprises fifteen cyclones 50, each of which has a significantly smaller diameter than the cylindrical first cyclone unit 20 and so is capable of separating finer dirt and dust particles due to the increased speed of the airflow therein. The separation efficiency of the cyclones is therefore considerably higher than that of the cylindrical first cyclone unit 20.

It will be appreciated that the first and second cyclonic separating units function to remove dirt particles from the air flow and deposit them in the dust collecting zone 34 from which they may be removed by the openable door 26. Having described the operation of the cyclonic separator in detail, the description will now focus on the mechanism by which the cyclone separating apparatus can be emptied and, moreover, how the outer bin may be removed from the separating apparatus by a user to allow access to other components of the cyclonic separator such as the shroud for cleaning.

FIGS. 3*a*, 3*b*, 3*c* and 3*d* illustrate, in overview, the procedure by which the door 26 of the separating apparatus 12 is opened in order for dirt to be emptied, and the way in which the bin 24 of the separating apparatus 12 may be removed so that a user is able to clean the bin 24, and also the shroud 38, as part of periodic maintenance.

The bin door 26 may be opened by means of an actuator 98 that is provided on the main body. In this embodiment, the actuator 98 is slidably mounted to a spine component 99 of the main body which lies adjacent to the bin 24 and extends in an upright direction between the motor housing 5 and a horizontal battery mount member 100.

Figure 3A:
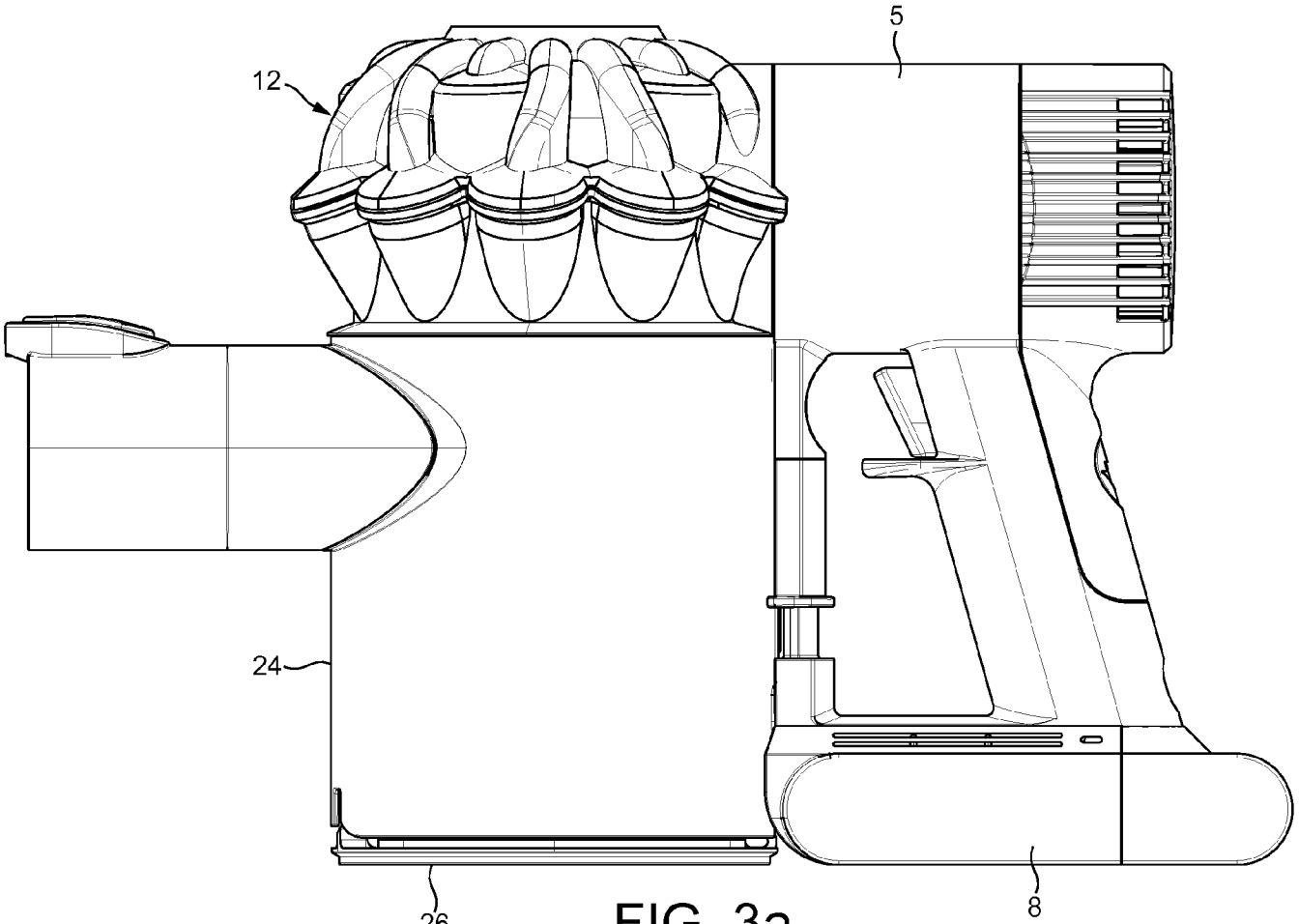
FIGS. 3*a* to 3*d* are a sequence of side views of the cleaning appliance which show the sequential operations to, firstly, open a door of the bin and, secondly, to remove the bin from the separating apparatus.
Figure 3B:
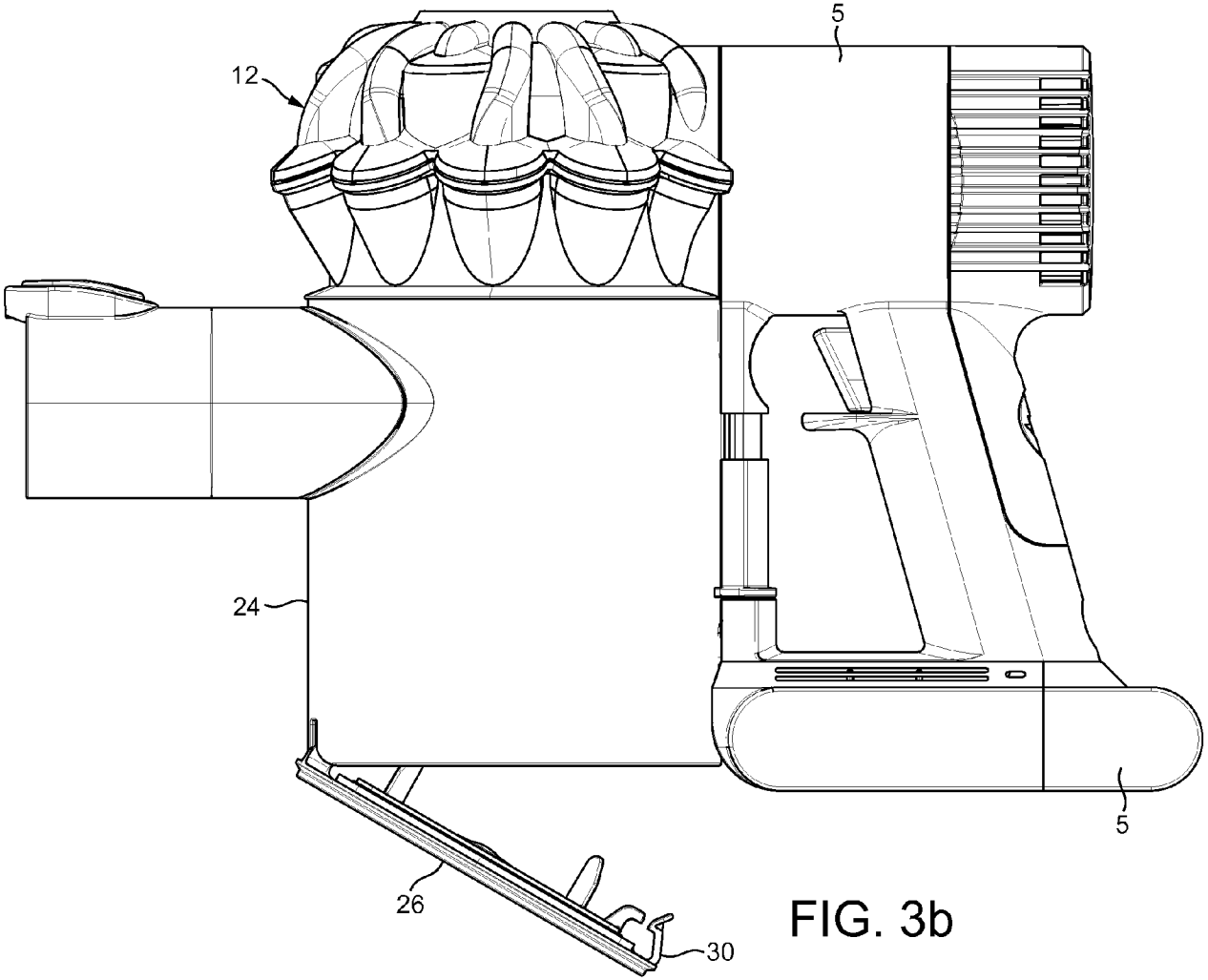

In FIG. 3*a*, the actuator 98 is in a first position, in which state the bin door 26 is locked closed against the lower end of the bin 24. The actuator 98 is movable downwards from this position into a second position, as shown in FIG. 3*b*, which causes the bin door 26 to swing away from the bin 24, thereby allowing the bin 24 to be emptied. The actuator 98, once released, is biased to return to the first position, as will be described.

Figure 3C:
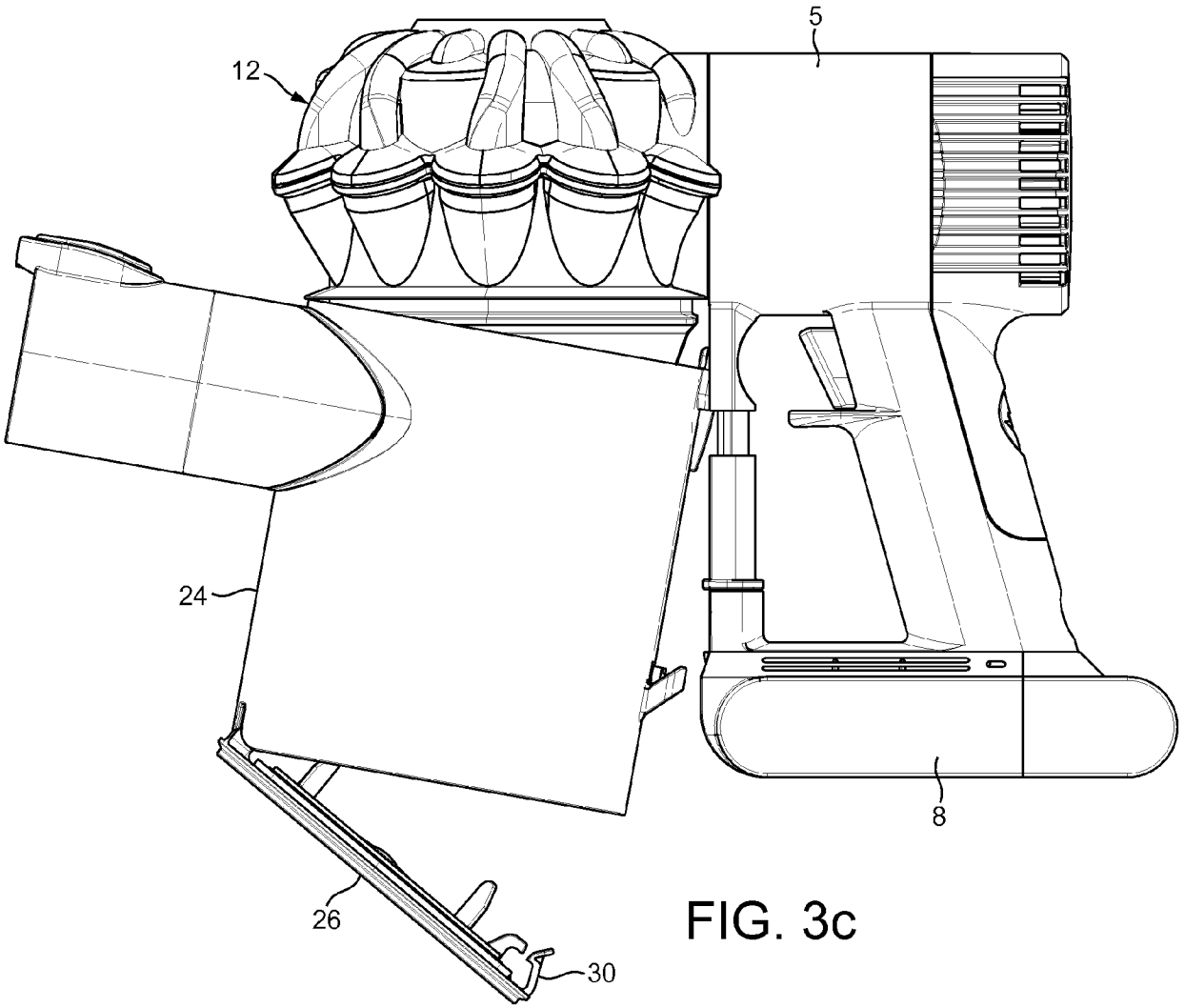

During circumstances when the bin door 26 is opened, as in FIG. 3*b*, the actuator 98 is movable a second time from the first position into the second position in which state the actuator 98 causes the bin 24 to be disengaged from the separating apparatus 12. FIG. 3*c* shows the actuator 98 in the second position during a second operation. It will be appreciated that the bin is disengaged slightly from its engaged position so as to be 'presented' to a user so that a user can pull the bin 24 away from the rest of the separating apparatus 12.

Figure 3D:
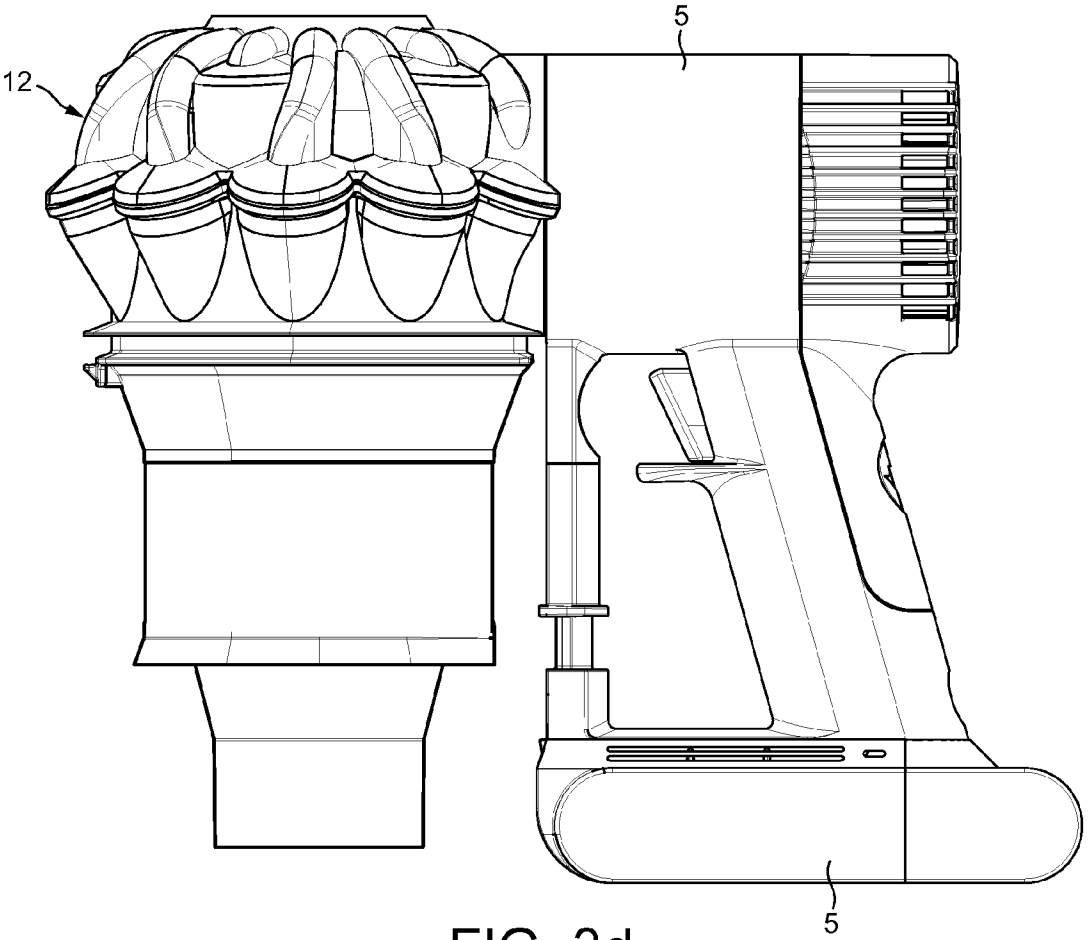

FIG. 3*d* shows the bin 24 removed completely from the separating apparatus 12, with the actuator 98 moved back into the first position. In summary, the actuator 98 is operable to carry out a sequence of two operations: a first operation to open the bin door 26 and a second operation to disengage the bin 24 from the separating apparatus 12. The benefit of this is that the user need only manipulate a single actuator in order to perform two operations. Ordinarily, the user will more often only need to operate the actuator 98 once in order to open the bin door 26 so as to empty the bin 24. However from time to time, the user may also wish to remove the bin 24 from the separating apparatus 12 in order to clean the shroud 38 of blockages and perhaps to clean the walls of the bin 24. With the invention, the user is simply required to operate the actuator 98 a second time whilst the bin door 26 is opened in order to release the bin 24 from the separating apparatus 12. This provides a simple user interface as there is no need for the user to locate a second actuator in order to remove the bin. Furthermore, the sequence of operation ensures that dirt is emptied from the bin 24 before the bin 24 can be removed from the separating apparatus 12 which has an associated hygiene benefit.

By way of example of a mechanism that embodies the invention, reference will be made to FIGS. 4 to 9 which show the actuator 98 and its associated actuating mechanism 101 together with the position of the bin 24 and bin door 26 in the positions illustrated in FIGS. 3*a* to 3*d*. Note that FIG. 5 shows an enlarged portion of FIG. 4. At this point, it should be mentioned that the bin 24 is shown in 'cut-away' form and that the separating apparatus 12 is not shown in order that the actuating mechanism 101 can be illustrated more clearly.

As mentioned above, the actuator 98 is slideably mounted to the spine 99 between a first, upper position and a second, lower position. Note that the actuator 98 is shown in the first position in FIGS. 4 and 5 and in the second position in FIG. 6. The actuator 98 is associated with a primary linkage member 102 that is directly coupled to the actuator 98 and is slidable therewith on the opposite side of the spine 99. The primary linkage member 102 is mounted to the actuator 98 on a pivot pin 104 associated with the actuator 98 and which projects through a slot 106 in the spine 99 and is slidable within the slot 106 through a vertical movement. Movement of the actuator 98 up and down along the spine 99 therefore moves the primary linkage member 102.

The primary linkage member 102 is generally an inverted L-shaped and is mounted to the pivot pin 104 at an elbow portion 108. The primary linkage member 102 further includes a first arm portion 110 that extends from the elbow portion 108 in a downwards direction and bears against an upper end 112*a* of an intermediate link member 112 in the form of a push rod. The push rod 112 further includes a lower end 112*b* which bears against the catch 30 of the bin door 26. The actuator 98 therefore is able to act on the catch 30 through the primary linkage member 102 and the push rod 112.

Figure 4:
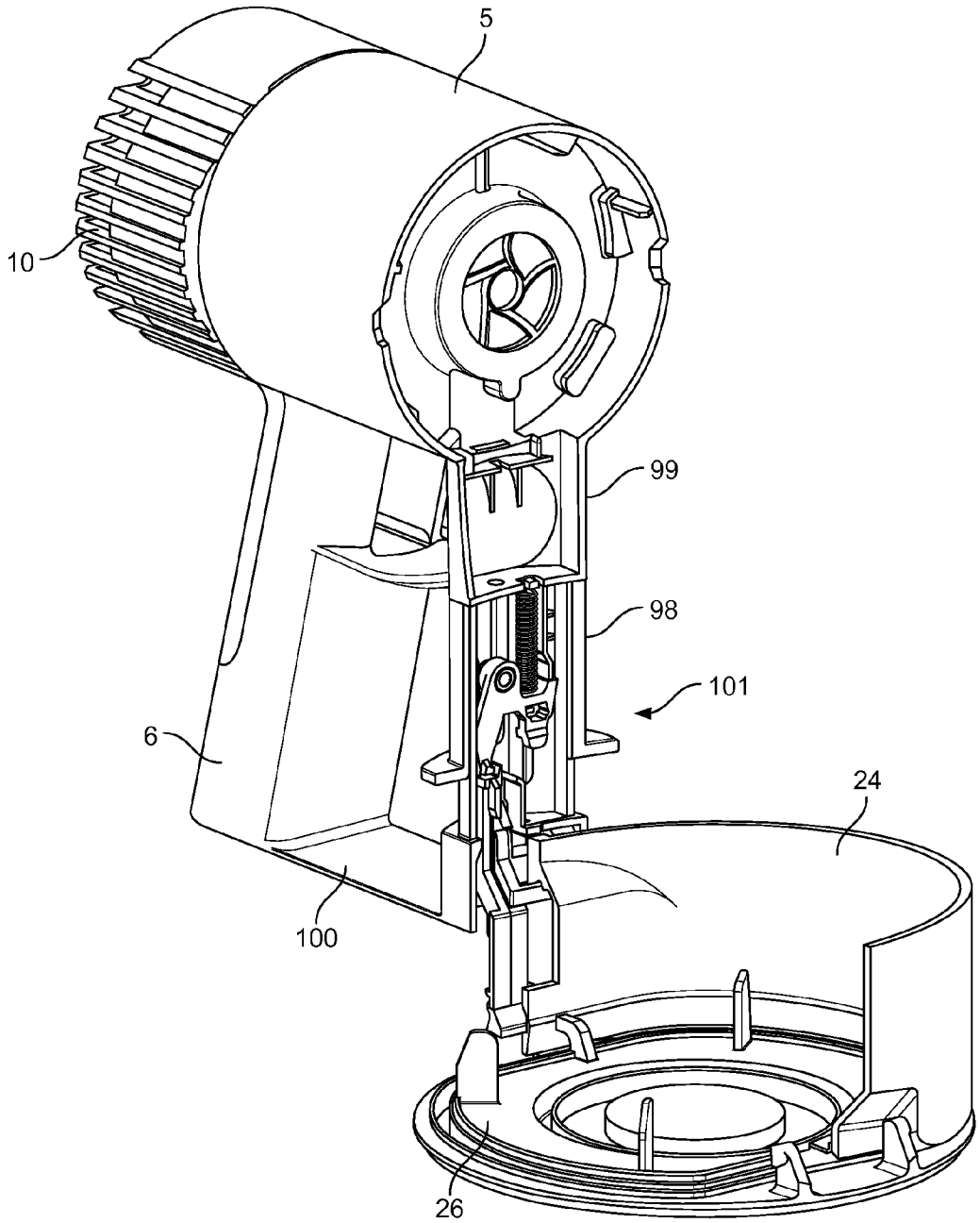
FIG. 4 is a perspective view in which the main body of the appliance is split from the separating apparatus and which shows internal components of the actuating mechanism by which the separating apparatus may be opened for emptying purposes.
Figure 5:
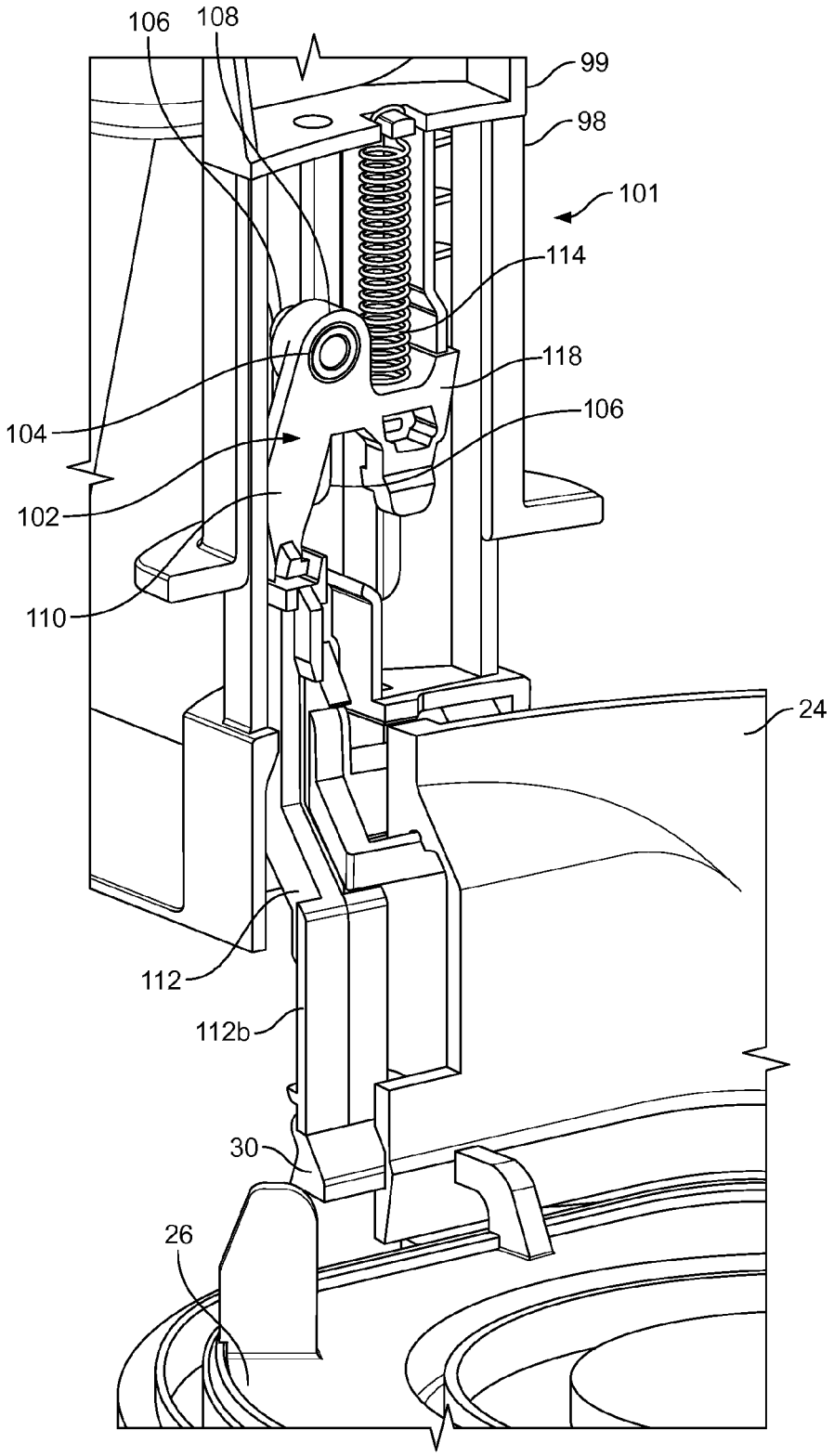
FIGS. 5 to 9 are a sequence of perspective views, based on FIG. 4, which show the internal components of the actuating mechanism in a series of operations to open the bin door and to release the bin from the separating apparatus.

As can be seen by comparing FIGS. 4 and 5, as the actuator 98 is pushed downwards from the first position to the second position, the primary linkage member 102 also moves in a downward direction thereby acting through the push rod 112 to release the catch 30 on the bin door 30 which enables the bin door 26 to swing away from the bin 24 so that it can be emptied of dirt.

Figure 7:
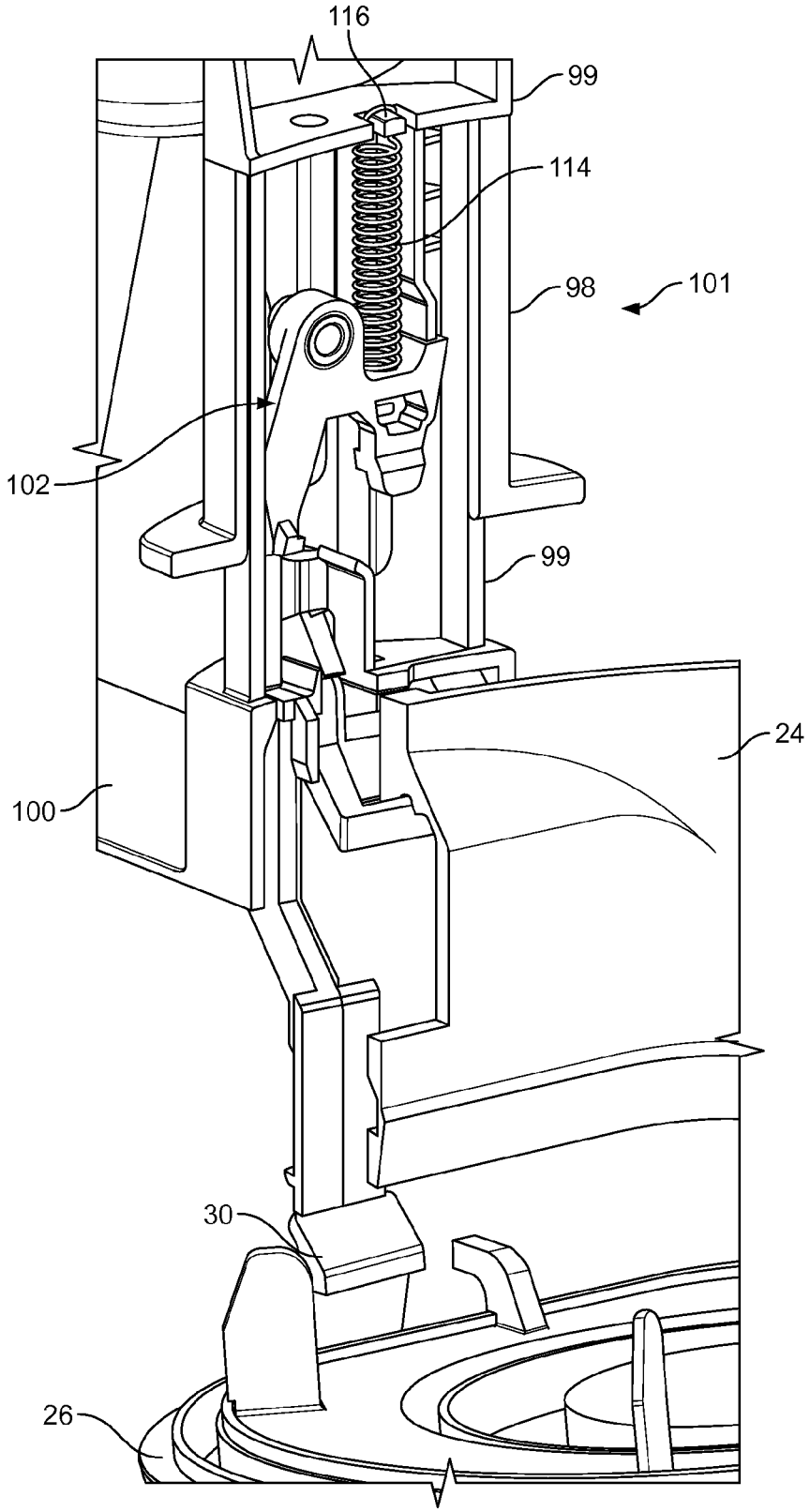

Following the release of the bin door 26, the actuator 98 returns to the first, upper, position assisted by biasing means which, in this embodiment, takes the form of a coil spring 114, although it will be appreciated that other means to return the actuator to the first position are possible such as a resilient rubber member. This position is shown in FIG. 7. The spring 114 is connected between a spring mount 116 on an upper part of the spine 99 and a second arm portion 118 of the primary linkage member 102 which extends away from the first arm portion 110 approximately at a right angle.

Figure 8:
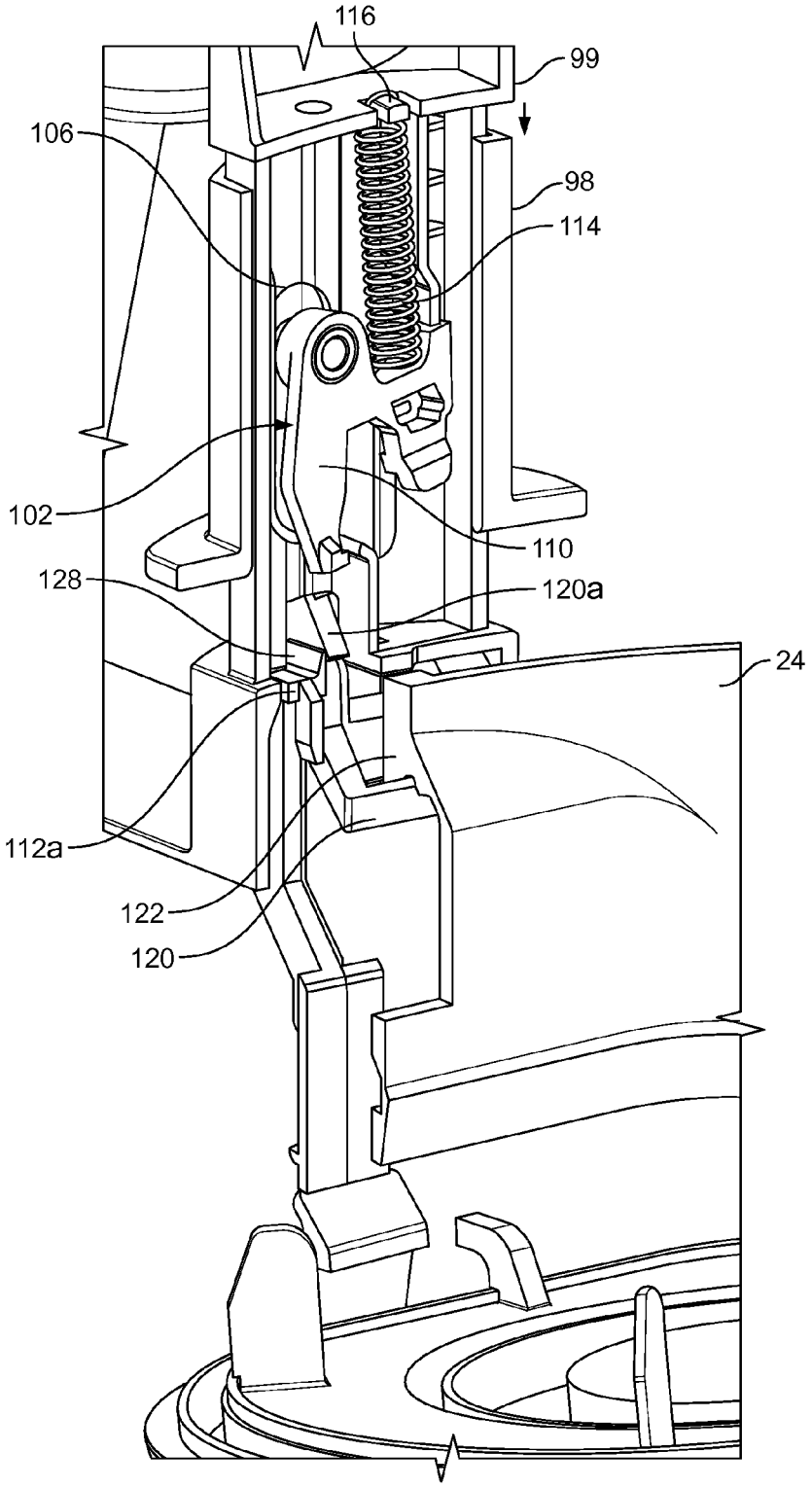
Figure 9:
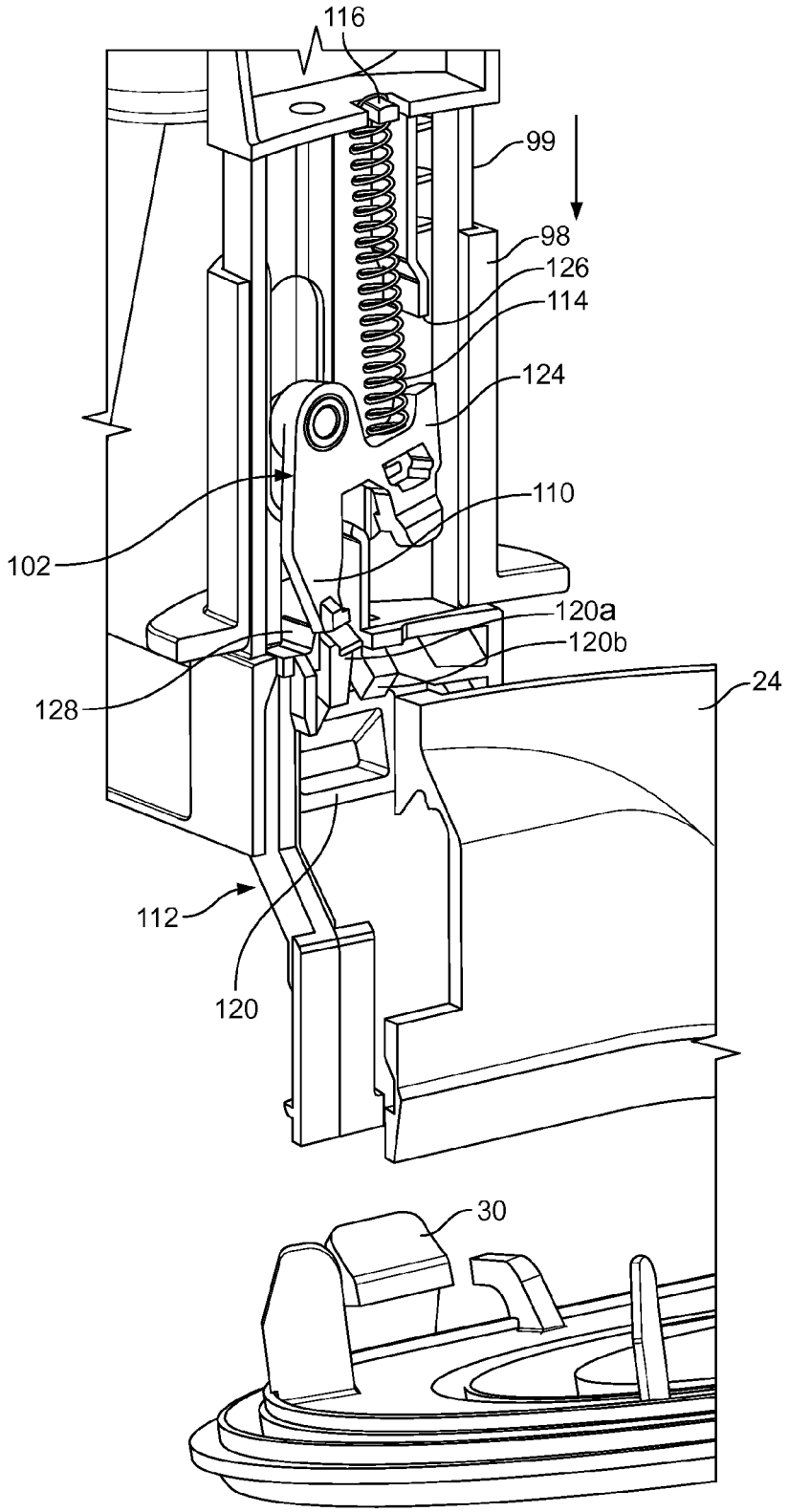

FIG. 8 shows the actuator 98 moved away from the first position towards the second position in order to release the bin 24 from the main body 4, whereas FIG. 9 shows the actuator 98 fully depressed into the second position. Referring firstly to FIG. 8, when the actuator 98 is moved in a downwards direction for a second operation, the retaining force of the spring member 114 causes the primary linkage member 102 to move angularly in a counter-clockwise direction which moves the first arm portion 110 out of line with the upper end 112*a* of the push rod 112 and into line with a contact point 120*a* of a U-shaped bin catch member 120 which is ordinarily engaged with a lug 122 defined on the lower end of the bin 24. As the primary linkage member 102 is moved further downwards, as shown in FIG. 9, the first arm portion 110 of the primary linkage member 102 comes into contact with the contact point 120*a* of the bin catch member 120 which is then rotated out of engagement with the lug 122 on the bin 24. As the bin catch member 120 rotates, an extension part 120*b* of the bin catch member 120 contacts the lug 122 which pushes the entire bin 24 in a downwards direction by a small amount so as to break the upper seal of the bin 24. In this manner, the bin 24 is slightly dislodged from its 'home' position following the disengagement of the bin catch member 120 from the lug 122 thereby presenting the bin 24 which acts as a visual cue for the user that the bin 24 may now be removed from the separating apparatus.

Figure 6:
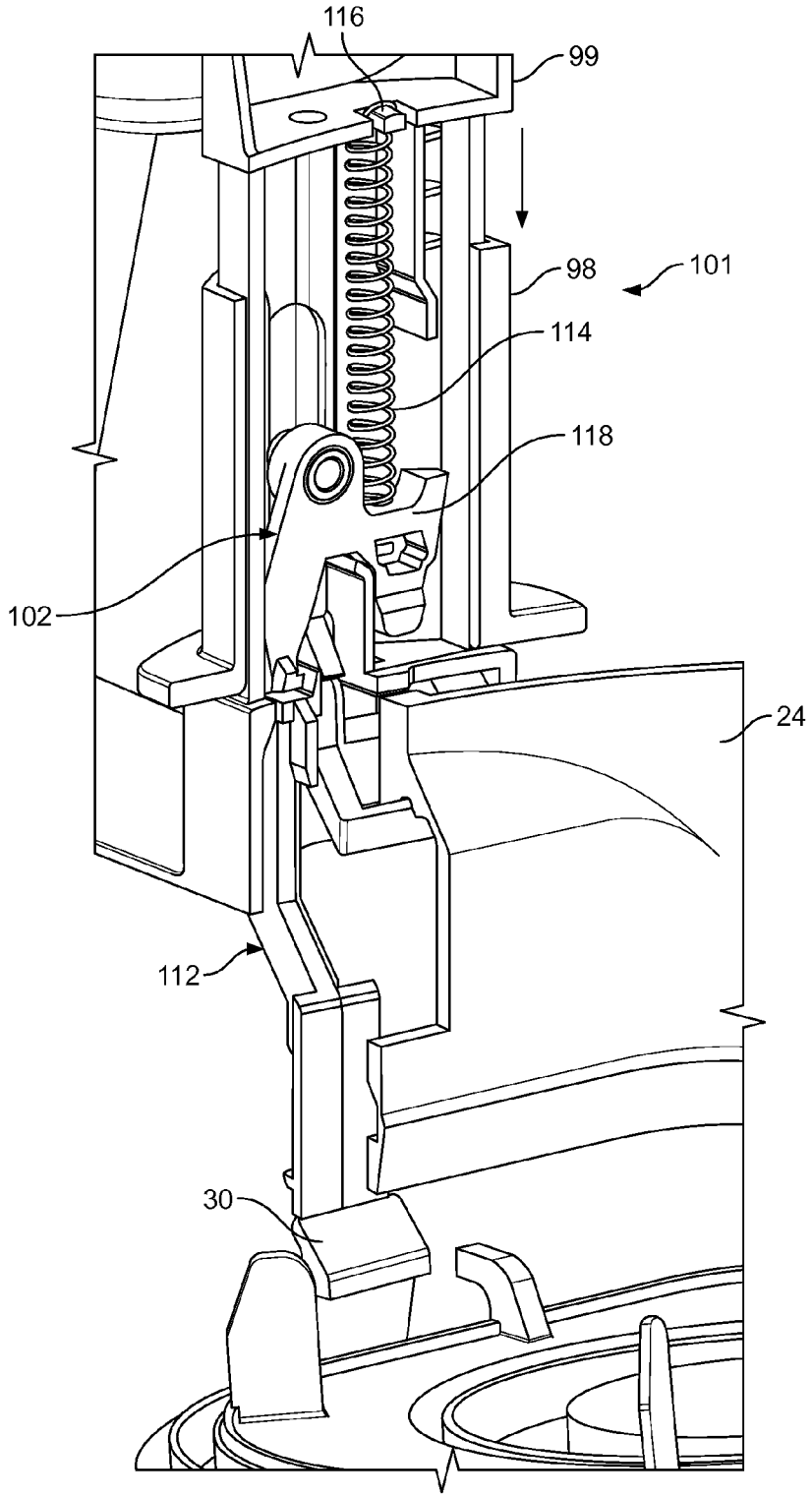

Following the release of the bin, the actuator 98 is released so as to return into the first position as shown in FIGS. 5 and 6. As the primary linkage member 102 is returned to its 'starting' position, an enlarged end 124 of the second arm portion 118 contacts a stop feature 126 of the spine 99 which causes the primary linkage member 102 to move angularly in a clockwise direction thereby moving the end of the first arm portion 110 into alignment with the upper end 112*a* of the push rod 112 when the bin door 26 is closed. It should be noted at this point that the upper end 112*a* of the push rod 112 includes an upstanding projection or 'lip' 128 which retains the first arm portion 110 in alignment with the push rod 112 throughout the first push sequence moving from the first position to the second position.

From the above, the skilled person will appreciate that the bin opening mechanism 101 operates to perform two functions sequentially using a single actuating button: a user presses the actuator 98 a first time to open the bin door 26, but the user may also press the actuator 98 a second time when the bin door 26 is in an open position in order to remove the bin 24 from the cyclonic separating apparatus 12. This arrangement provides a simple user interface since a single button does the job of two buttons provided in known handheld vacuum cleaners, such as disclosed in WO2010/061211. It is therefore intuitive to use and, moreover, it is not necessary for the user to remove the separating apparatus from the cleaning appliance before emptying the bin. Furthermore, such an arrangement is advantageous in terms of packaging because only a single opening mechanism needs to be provided on the vacuum cleaner which therefore allows for a more compact design.

Having described the manner in which the bin door 26 may be opened to release dirt from the separating apparatus 12, and how the bin 24 itself may be removed from the separating apparatus 12, discussion will now focus on the arrangement by which the separating apparatus 12 is connectable with the main body 4 of the vacuum cleaner. In the following description, reference will be made particularly to FIGS. 10 to 18.

Figure 10:
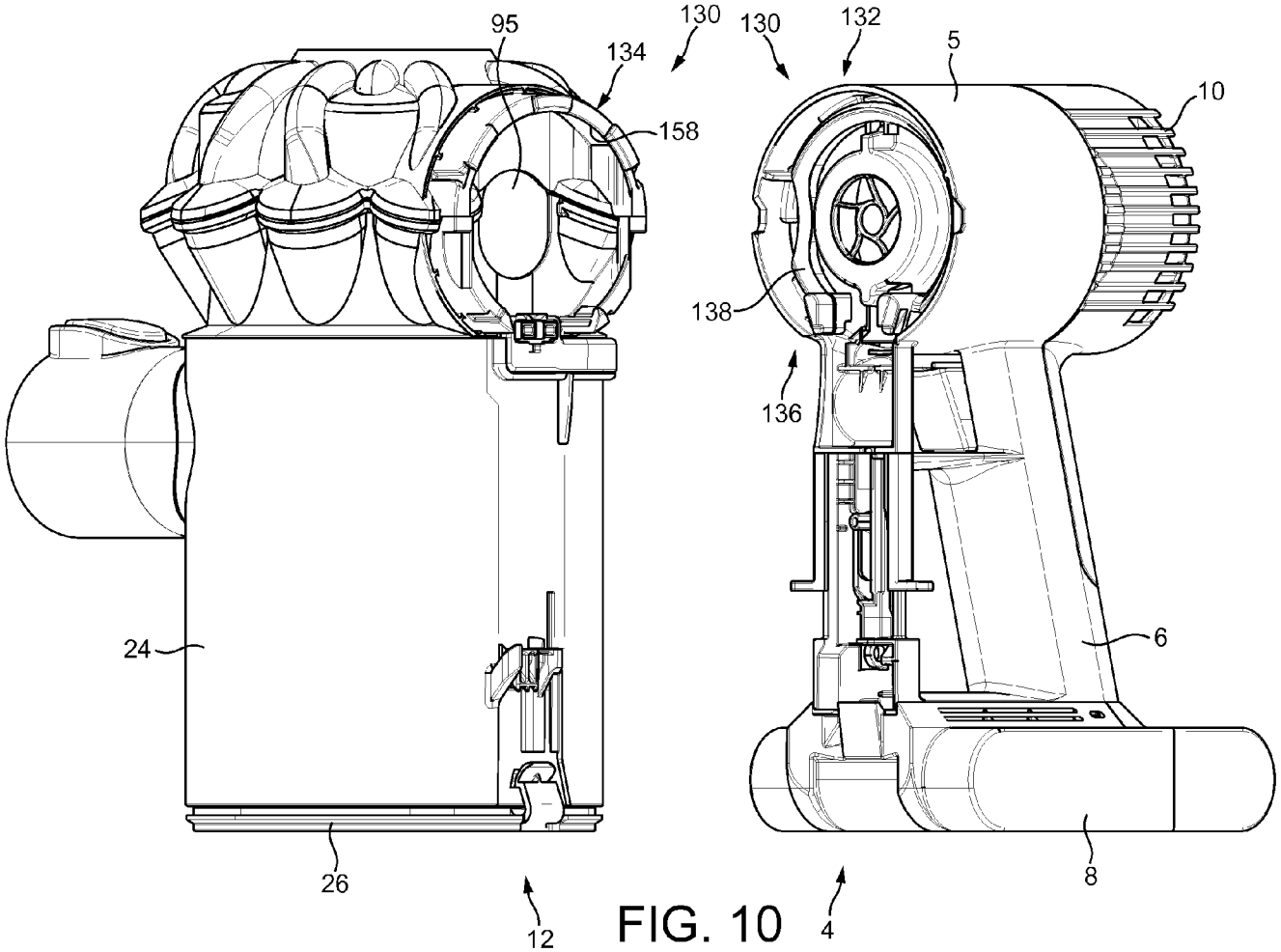
FIG. 10 is a perspective view of the main body of the cleaning appliance separated from the separating apparatus showing a further aspect of the invention.
Figure 11:
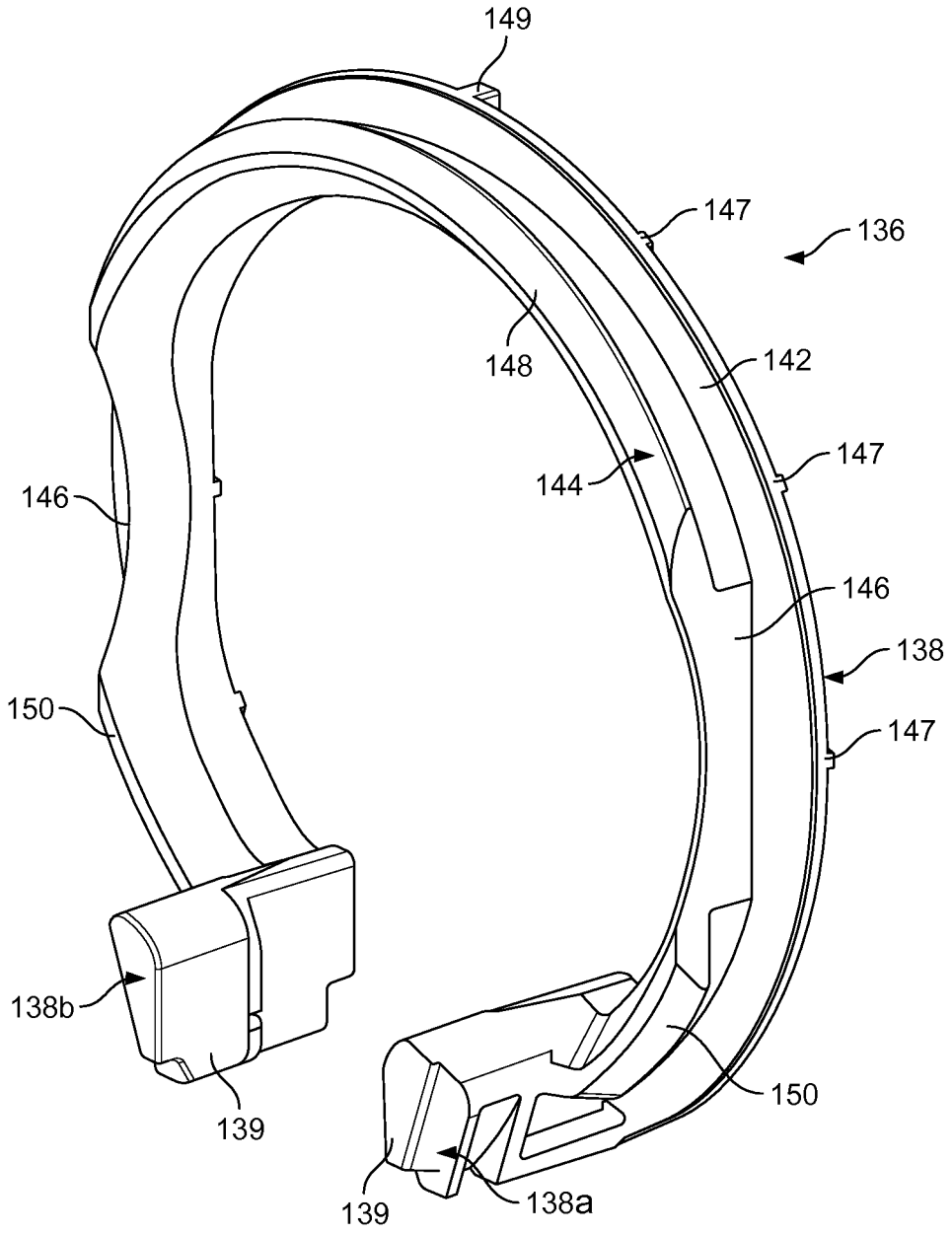
FIG. 11 is a perspective view of the resilient member in FIG. 10.

Referring firstly to FIG. 10, the main body 4 of the handheld vacuum cleaner is removably connected to the separating apparatus 12 at a mechanical interface 130. The mechanical interface 130 comprises a first interface portion 132 provided on the main body 4 and a second interface portion 134 provided on the separating apparatus 12. In this embodiment, the first interface portion 132 and the second interface portion 134 are substantially circular, although it should be appreciated that this is not essential to the invention as will become apparent in the following description. As can be seen, the air flow from the separating apparatus flows through the interface 130. As will be explained, the first interface portion and the second interface portion are locked together radially about at least a portion of the interface. Since the interlock between the first and second interface portions extends about at least a portion of their circumference, this results in a very strong, but releasable, connection. At the extreme, the two portions can be interlocked continuously about the entirety of the interface. Alternatively, the two portions can be interlocked at multiple discrete points distributed radially about the interface.

In this specific embodiment, the two portions 132, 134 of the mechanical interface 130 are releasably connected by way of an connecting means 136 which includes, at least in part, a ring-shaped resilient member 138 or 'C-clip/circlip' having first and second ends, labelled here as 138*a* and 138*b*. The resilient member 138 is shown in situ in FIG. 10 but is shown in isolation from the main body 4 in FIGS. 11, 12*a* and 12*b*.

Each of the first and second ends 138*a*, 138*b* of the resilient member 138 has an enlarged gripping foot 139. In this embodiment the resilient member 138 is polymeric, preferably polycarbonate, although it may also be a different material such as a suitable metal. Plastics are currently preferred due to cost and strength. By virtue of the shape of the resilient member 138 and the material of which it is made, it is resilient radially, in that it is flexible such that its outer diameter may be reduced. Therefore, a force applied to the gripping feet 139 of the resilient member 138 to close the gap between the ends acts to decrease the outside diameter of the resilient member, and the importance of this feature will be explained later.

The resilient member 138 has a generally U-shaped cross section thereby forming a circumferential channel 140 around its outer periphery. A first radial flange 142 provides a first, rear, wall of the channel 140 and a second radial flange 144 provides the front wall of the channel 140. In this particular embodiment, the rear flange 142 is continuous about substantially the entire circumference of the resilient member 138 although, as can be seen particularly clearly in FIG. 12*a*, the continuity of the second flange 144 is interrupted by two cut-outs or 'flats' 146, one on each side of the resilient member 138. It should be appreciated that the flats 146 are not essential to the invention and are provided here in order to provide space within the internal volume of the interface for additional structural features, for example screw bosses. If the flat 146 were omitted, the second flange 144 may be continuous and therefore provide an even stronger connection.

The flats divide the front flange 144 into a first, upper wall portion 148 and first and second lower wall portions 150. The lower wall portions 150 have a different cross sectional profile to the upper wall portion 148, as is shown most clearly in FIG. 12*b*, and as will now be explained.

Figure 12A:
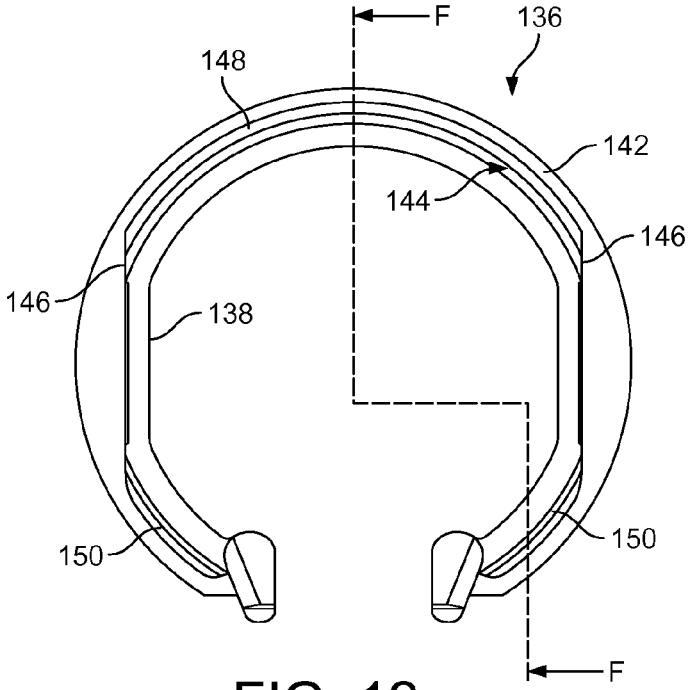
FIG. 12*a* is a view of the resilient member from the front and FIG. 12*b* is a section view along the line F-F in FIG. 12*a;*
Figure 12B:
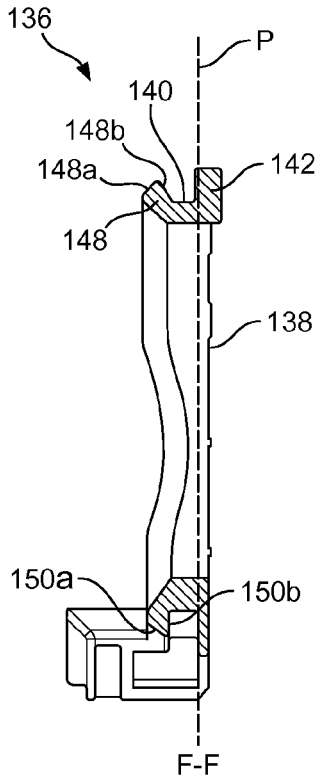

The upper wall portion 148 comprises inner and outer faces 148*a*, 148*b*, both of which are inclined with respect to the rear flange 142, which extends along a vertical plane P as shown in FIG. 12*b*. In contrast, the lower wall portions 150 also comprise inner and outer faces 150*a*, 150*b*, but only the inner face 150*a* is inclined to the rear flange 142 whereas the outer face 150*b* is parallel to the rear flange 142 and, thus, the plane P. The cross sectional profile of the front flange 144 enables the mechanical interface to be connected and disconnected, as will now be explained.

Figure 13A:
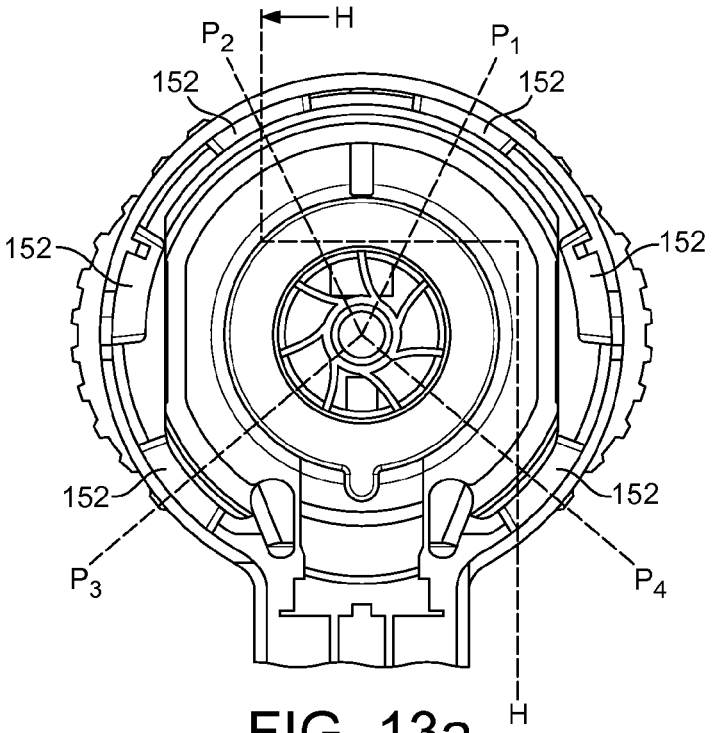
FIG. 13*a* is view of the resilient member in-situ in the mechanical interface of the main body.
Figure 13B:
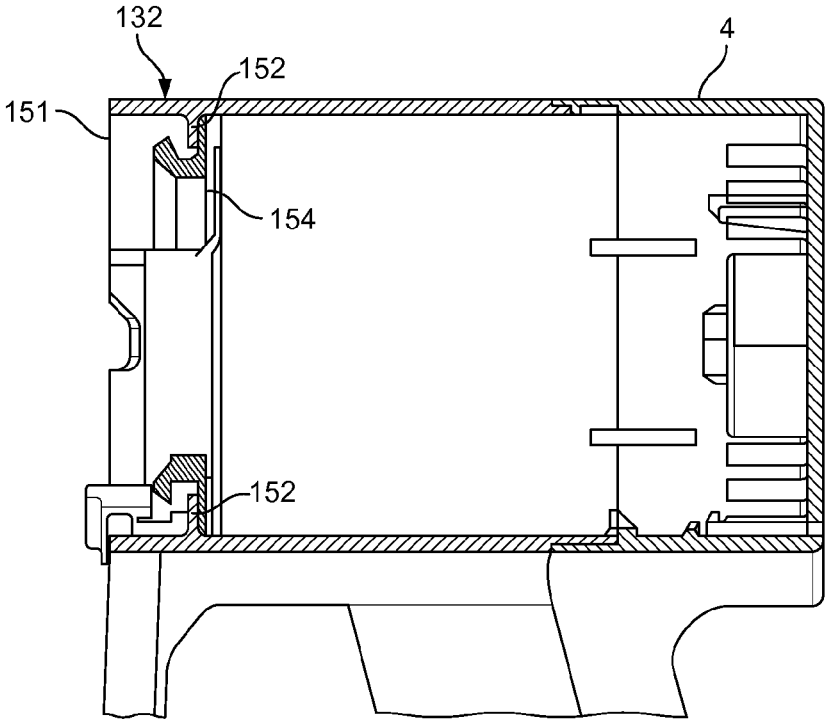
FIG. 13*b* is a cross section along the line H-H.

Although it is a separate part, the resilient member 138 is captive on the first interface portion 132 of the main body 4 and so is held within an internal chamber 151 defined by the first interface portion. As shown in FIGS. 13*a* and 13*b*, the first interface portion 132 includes a plurality of tabs 152. In this embodiment there are five tabs 152 in total, although the skilled person will appreciate that this is not essential. The tabs 152 are spaced radially around the circumference of the first interface portion 132 and extend inwardly by a short distance. The tabs 132 are spaced from a back plate 154 of the first interface portion 132 which enables the rear flange 142 of the retaining member 138 to be secured behind the tabs 152 such that the tabs 152 sit in the channel 140 of the retaining member 138. This is shown clearly in FIG. 13*b*.

Figure 14:
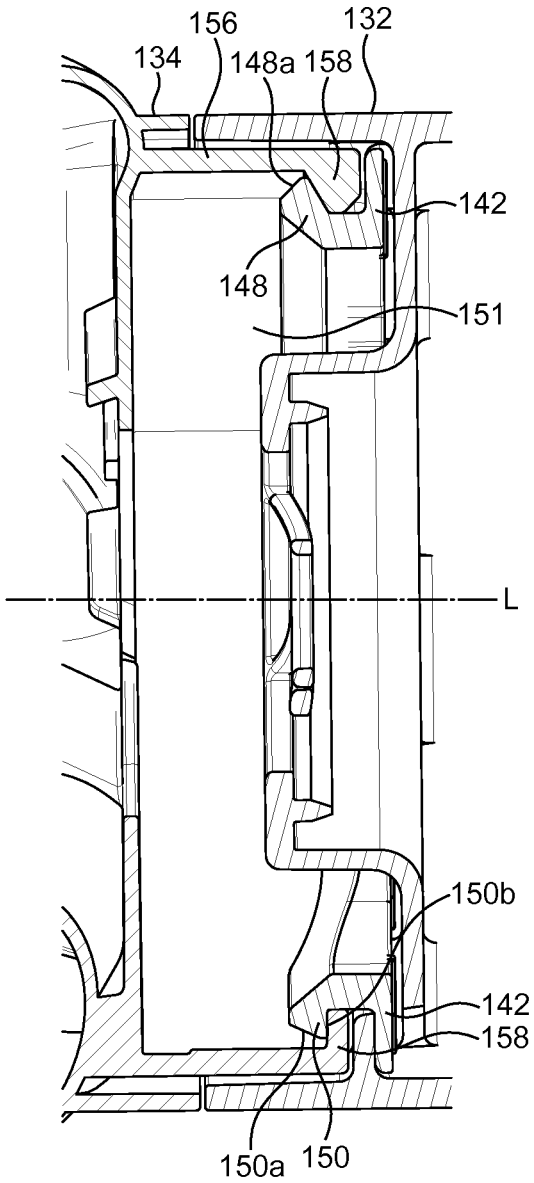
FIG. 14 is an interior view of the mechanical interface between the main body and the separating apparatus in an assembled condition thereby showing the engagement between the first interface portion, the resilient member and the second interface portion.
Figure 15:
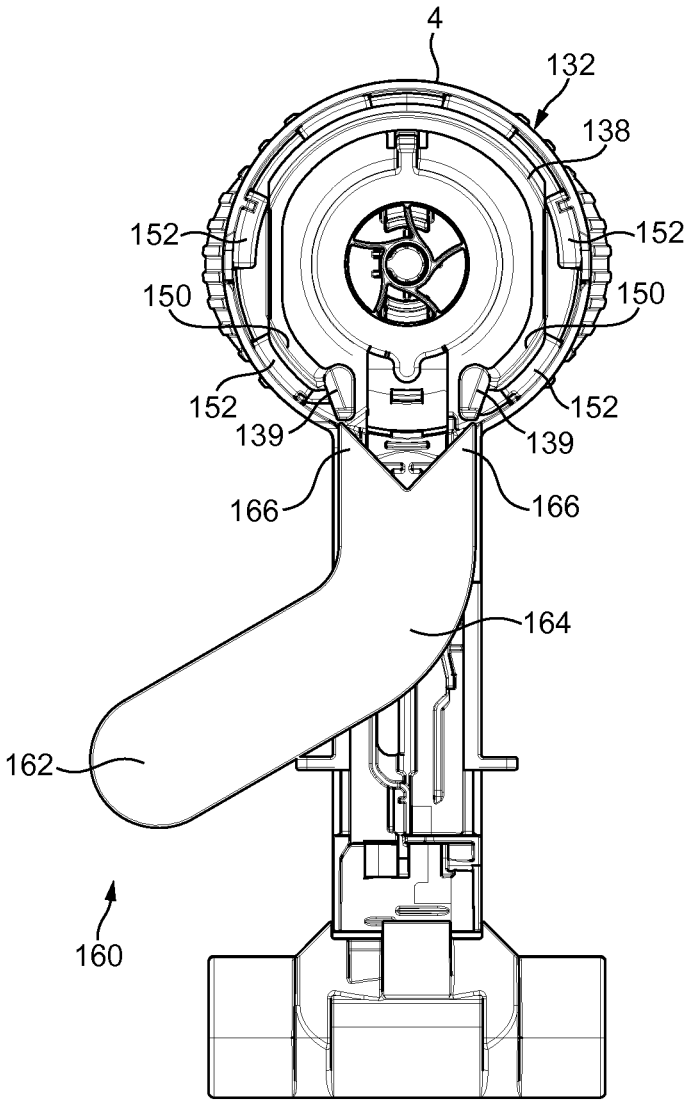
FIG. 15 is a view of the main body and a tool for interacting with the resilient member.
Figure 16:
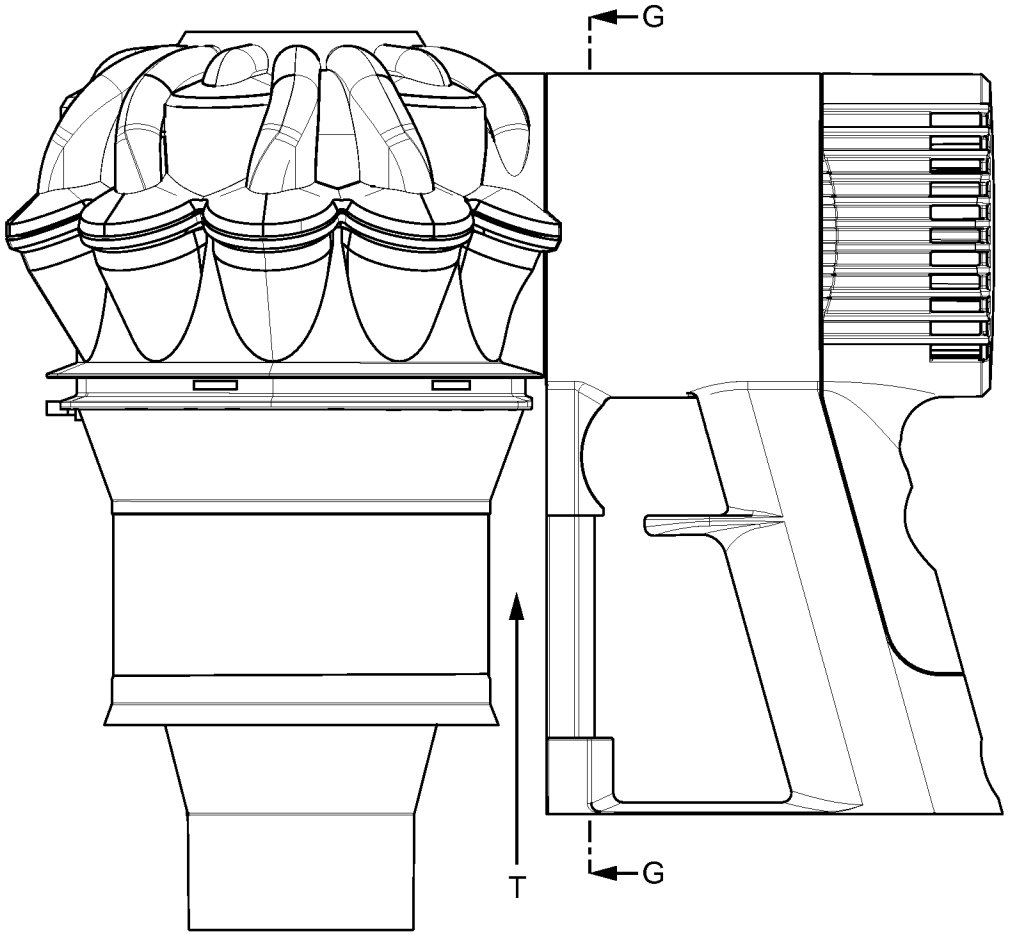
FIG. 16 is a side view of the main body attached to the separating apparatus and illustrates the insertion point of the tool shown in FIG. 15.

In order to secure the second interface portion 134 to the first interface portion 132, the two interface portions can simply be pressed together. As shown in FIG. 14, the second interface 134 portion includes a short tubular section 156 having a smaller diameter than that of the circular profile of the first interface portion 132 so that the second interface portion 134 can be received inside the first interface portion 132. The second interface portion 134 includes an inwardly extending radial lip 158 that connects to the resilient member by engaging over the upper wall portion 148 and the lower wall portions 150. Thickened segments 159 of the lip 158 fit between the tabs 152 and have the effect of reducing the axial length of the interface 130.

As the second interface portion 134 is pushed into engagement with the first interface portion 132, the leading edge of the lip 158 engages the angled outer faces 148*a*, 150*a* of the front wall 144 of the resilient member 138. This radially compresses the resilient member 138 and therefore allows the lip 158 of the second interface portion 134 to engage into the channel 140 of the resilient member 138. It should be noted that FIG. 14 shows the first interface portion and the second interface portion in the fully engaged position such that the interface 130 extends about the longitudinal axis L.

When in the fully engaged position, the first and second interface portions 132, 134 are securely locked together and cannot be pulled apart freely. The resilient member interlocks the first and second interface portions at radial regions that extend about the interface. As illustrated by the enlarged view of the interlock between the two interface portions 132, 134 in FIG. 14, the lower wall portions 150 of the resilient member 138 and the lip 158 of the second interface portion 134 engage at a plane P which is parallel to the rear wall 142 of the resilient member 138. Therefore, by virtue of the complementary profiles of the resilient member 138 and the second interface portion 134, the lip 158 cannot simply be pulled out of engagement from the channel 140 of the resilient member 138. Furthermore, the first and second interface portions 132, 134 interlock at multiple points or regions that extend radially about the periphery of the portions which results in a very strong connection in multiple 'planes', as is illustrated by the planes P1 to P4 in FIG. 13*a*. The resilient member therefore acts as a mechanical fastener.

It should be appreciated that if the outer face 150*b* of the resilient member 138 and the lip 158 were angled as opposed to being parallel with the back plane P, then it would be possible for the interface to be split apart relatively easily since the outer face 150*b* and the lip 158 profiles would cause the resilient member 138 to be 'bumped out' under a predetermined separation force pulling the interface components apart. In such an arrangement, then it would be necessary to include an interference means to the connection arrangement which would selectively prevent the resilient member from compressing in the radial direction.

In the illustrated embodiment, however, a tool is required to enable the first interface portion 132 and the second interface portion 134 to be separated, as will now be explained with reference to FIGS. 15 to 18. A tool 160 for separating the main body 4 from the separating apparatus 12 comprises a handle 162 and a working end 164 that extends obliquely to the handle. The working end 164 defines a forked interface for engaging the resilient member 138 and includes two spaced apart wedge shaped forks 166 that may be inserted through an aperture (not shown) in the second interface portion 134 so as to engage the gripping feet 139 of the resilient member 138. The insertion point for the tool is shown by the arrow T in FIG. 16.

Figure 17:
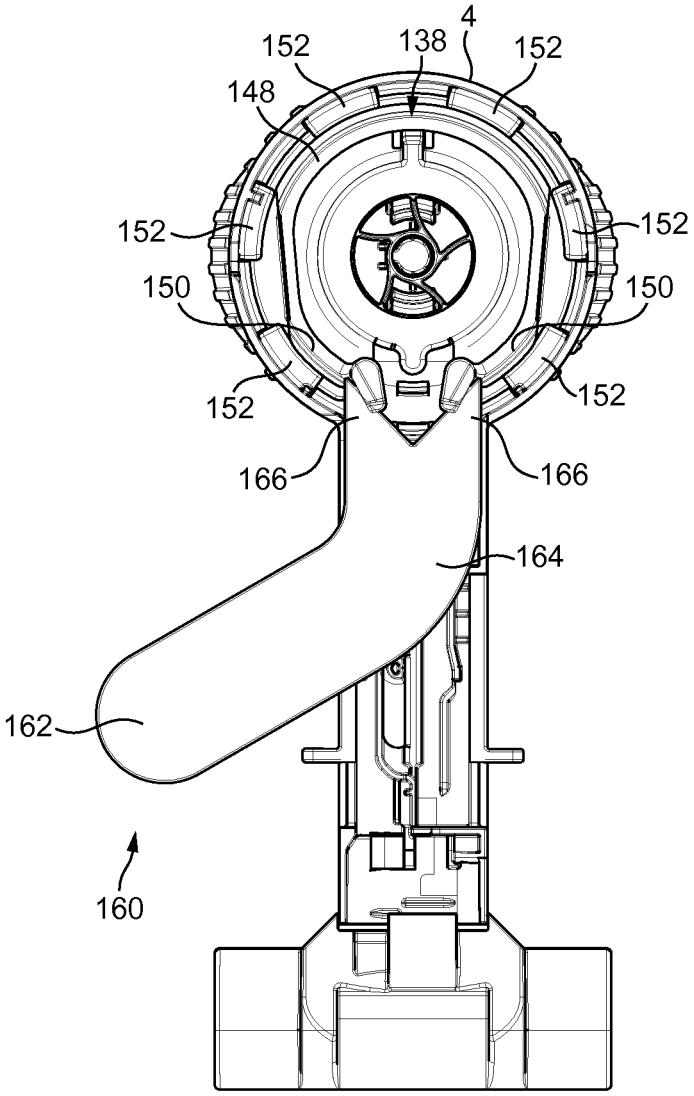
FIG. 17 is a view of the main body like that shown in FIG. 15 but shows the tool compressing the resilient member in a radial direction.

The gripping feet 39 provide angled faces to complement the forks 166 of the tool 160. The tool 160 therefore acts to squeeze the gripping feet 139 towards one another thereby radially compressing the resilient member 138. As shown in FIG. 17, insertion of the tool 160 has compressed the resilient member 138 such that the lower wall portions 150 are pulled clear of the lip 158 of the second interface portion 134. In order to minimise the force required to compress the resilient member, a plurality of running ribs 147 are provided on the rear wall to bear against an adjacent part of the first interface portion 132. The running ribs 147 reduce the surface area of the resilient member 138 that is in contact with the first interface portion and so reduces the friction between these parts. Of particular note is running rib 149 which projects further from the resilient member than the other running ribs 147. Running rib 149 locates with a key way (not shown) on the first interface portion and therefore stops the resilient member from turning angularly in use which may otherwise impair the function of the resilient member 138.

Figure 18:
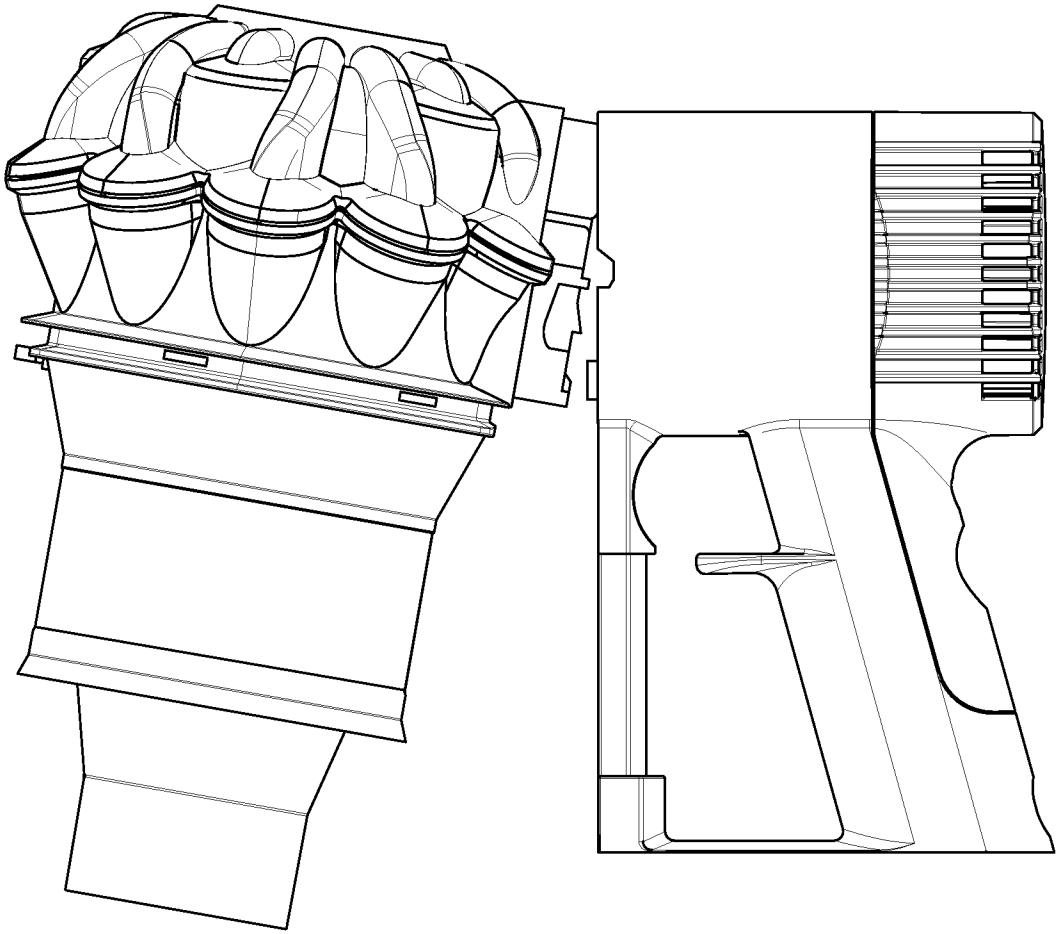
FIG. 18 is a side view that shows the main body and the separating apparatus being separated from one another.
Figure 19:
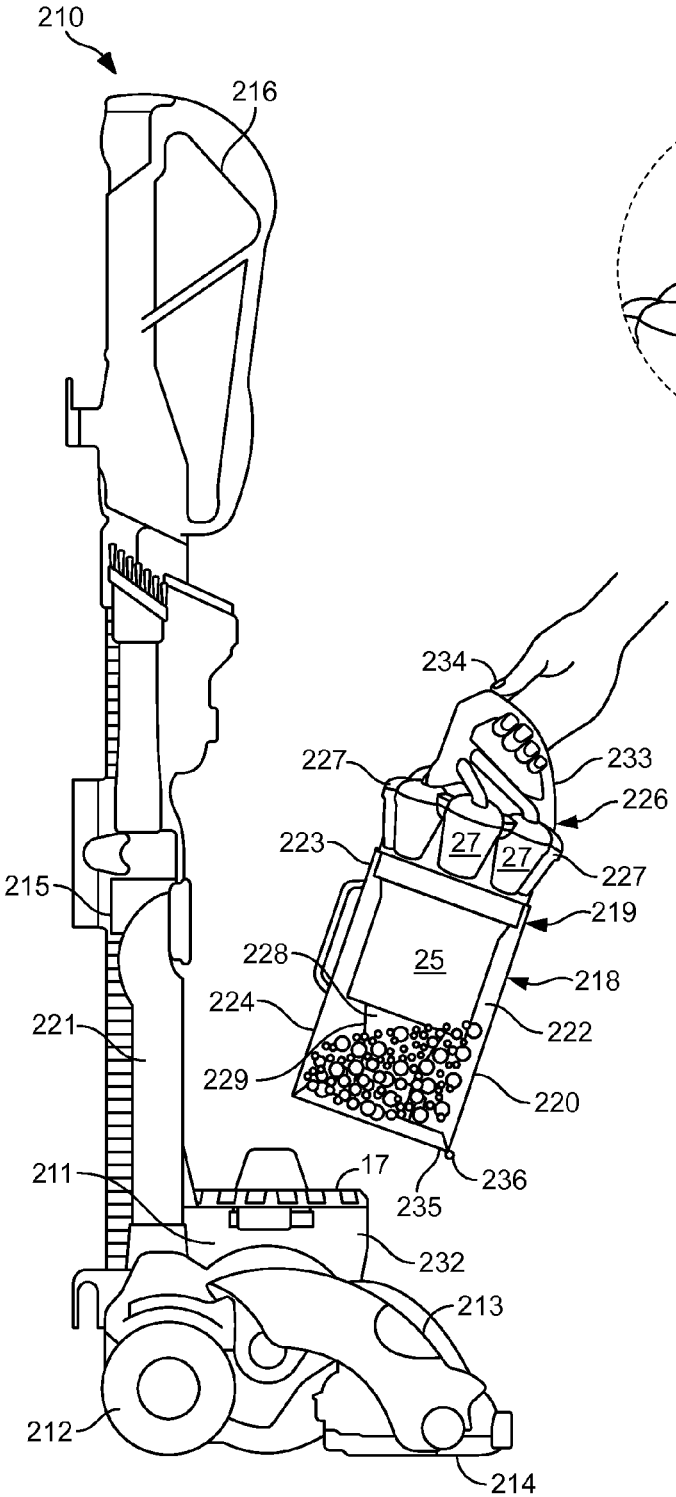
FIG. 19 is a side view of an alternative vacuum cleaner arrangement.

With the resilient member 138 compressed in this way, the second interface portion 134 can be pulled away from the first interface portion 132. The most effective way to achieve this is for the user to 'peel' the lower parts of the two interface portions 132, 134 away from one another thereby levering the upper part of the second interface portion 134 away from the angled catch faces of the first interface portion 132. This separating movement is shown in FIG. 18.

The connecting arrangement between the first and second interface portions 132, 134 provides a particularly robust configuration of securing the separating apparatus 12 to the main body 4 since the two interface portions are locked together across a radial span. In this specific embodiment a plurality of engagement regions or points distributed are radially spaced around the mechanical interface. This provides an interlocking connection between the two interfacing portion in multiple planes which results in there being very little 'play' between the parts. This provides a very secure connection and a high quality feel to the cleaning appliance. As an alternative to discrete points, or regions, of locking between the interface components, there may be provided a continuous locking interface over a significant portion of the circumference of the interface; in this case the separate tabs 152 would in effect be a single arcuate tab.

Although the interface has been described in the context of connecting a main body of a vacuum cleaning appliance to an associated separating apparatus, it should be appreciated that the same connecting scheme could also be used to connect together any two functional components of a vacuum cleaning appliance or, indeed any household appliance. For example, the same connection scheme could be used to connect a cleaner head to a wand or hose assembly, two parts of a wand/hose assembly, or even the base and a removable upper unit of a fan assembly, for example.

The skilled person will appreciated that variants and modifications to the specific embodiment described are feasibly within the scope of the invention as defined by the claims. Some have been mentioned above; others will be explained below. For example, it should be appreciated that the specific overall shape of the separating apparatus can be varied according to the type of vacuum cleaner in which the separating apparatus is to be used. For example, the overall length of the separating apparatus can be increased or decreased with respect to the diameter of the separating apparatus. Also, although the cyclonic separation is currently the preferred method of separating contaminants in the airflow within the context of the invention, a different means of dust separation could be used, for example a bagged separation system which does not involve cyclonic airflows or even a more conventional bagged system.

Figure 24A:
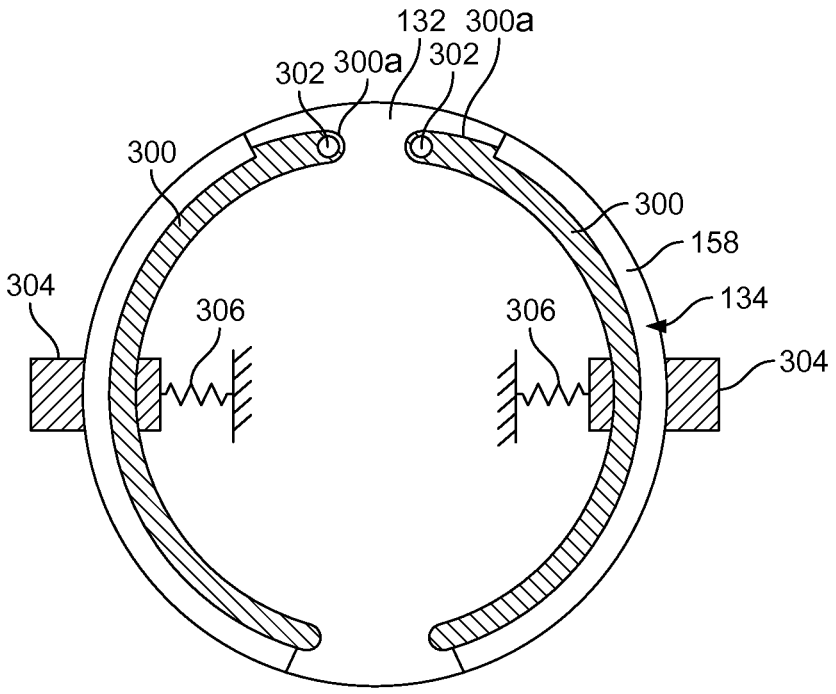
FIGS. 24*a* and 24*b* show schematically an alternative arrangement to the embodiment of FIGS. 10 to 17.
Figure 24B:
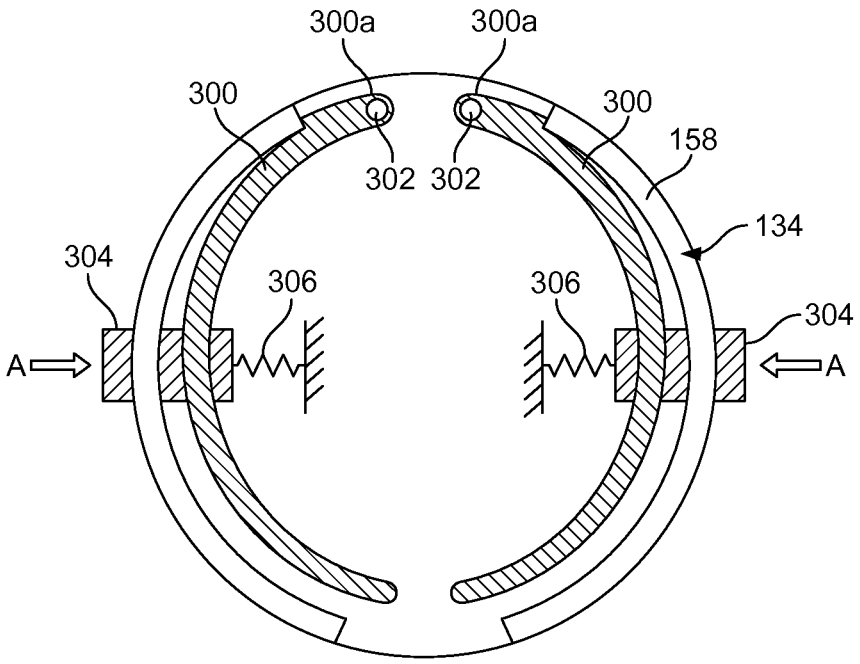

In the embodiments of FIGS. 10 to 17, a secure means of connection between the two interface components is achieved by way of a radially compressible resilient member. The skilled person will, however, appreciate that other components would achieve the same purpose, an example of which is shown in FIGS. 24*a* and 24*b*. Note that parts similar to the previous embodiments are referred with like reference numerals. In this arrangement, instead of a c-shaped resilient member 138 as in previous embodiments, the connection means is in part embodied by first and second opposed resilient members or 'catches' 300. Each catch is generally semicircular in shape and upper ends 300*a* of the catches are pivotably mounted at pivot points 302 on the first interface portion 132. Each catch 300 is movable inwardly by way of a respective user-operable button 304 and is biased outwardly, in this embodiment, by means of a spring 306.

In FIG. 24*a*, the catches 300 are in a locked position and are therefore in engagement with the lip 158 of the second interface portion. In this position, therefore, the first and second interface portions 132, 134 are locked together. In FIG. 24*b*, the catches 300 are in a second position. In this position, the buttons 306 are actuated, as indicated by the arrows A, which moves the catches 300 angularly about their respective pivots 302. In effect, therefore, the outer dimension of the catches 300 reduces so that they disengage with the lips 158 provided by the second interface portion 134. The catches 300 function in a comparable manner to the resilient member 138 to compress radially in order to release the interlock between the first and second interface portions 132, 134, so that the interface can be split apart. In the same way as the embodiment of FIGS. 10 to 17, the first and second interfaces are locked together in a radially distributed manner.

Returning to the arrangement discussed specifically in relation to FIGS. 3 to 9, it should be appreciated that one specific mechanism has been described by which a vacuum cleaner, and particularly an handheld vacuum cleaner, may be provided with a single actuating mechanism that enables both the bin door to be opened and also enables the bin to be released from the separating apparatus itself. However, within this concept, the skilled person will appreciate that other mechanisms may be devised that perform the same function.

In the arrangement described specifically in relation to FIGS. 10 to 17, the resilient member provides a convenient mechanism by which an interlocking interface may be provided between mating portions of the main body and the separating apparatus at radially extending region or regions about the circumference of the mating portions, thereby providing a robust connection between the main body and the separating apparatus that is resistant to torsion and bending forces. However, other mechanisms are feasible within the broad inventive concept defined by the claims.

The invention has been described within the context of a handheld vacuum cleaner which may also form part of a stick-vac cleaner. However, the skilled person will appreciate that the invention may also apply to other types of vacuum cleaners, for example upright vacuum cleaners and cylinder vacuum cleaners (also referred to as canisters or barrels.

By way of example, in FIGS. 19 to 22 an upright vacuum cleaner 210 comprises a main body 211 which includes a motor and fan unit (not shown) and a pair 212 of wheels. A cleaner head 213 is pivotably mounted on the lower end of the main body 211 and a dirty air inlet 214 is provided in the underside of the cleaner head 213 facing the floor surface. The main body 211 further includes a spine 215 which extends vertically upward and merges into a hand grip 216. The hand grip 216 can be manipulated by a user to manoeuvre the vacuum cleaner 210 across a floor surface. The main body 211 further includes outlet ports 217 for exhausting air from the vacuum cleaner 210.

Separating apparatus 218 is releasably held on the main body 211 of the vacuum cleaner 210. The separating apparatus 218 comprises a separator 219 and a collecting chamber 220. The separating apparatus 218 is supported on the main body 211 above the outlet ports 217 and lies adjacent the spine 215. The interior of the separating apparatus 218 is in communication with the dirty air inlet 214 through ducting 221 adjacent the spine 215. The separating apparatus 218 can be removed from the main body 211 for emptying and for maintenance.

In use, the motor and fan unit draws dirty air into the vacuum cleaner 210 via the dirty air inlet 214. The dirty air is carried to the separating apparatus 218 via the ducting 221 adjacent the spine 215. The separating apparatus 218 includes an upstream cyclone 222 in the collecting chamber 220. An air inlet 223 is formed in the cylindrical side wall 224 of the chamber 220. When the separating apparatus 218 is held on the main body 211 of the vacuum cleaner 210, the air inlet 223 is in communication with the dirty air inlet 214 and forms a communication path between the ducting 221 adjacent the spine 215 and the interior of the upstream cyclone 222. The air inlet 223 is arranged tangentially to the upstream cyclone 222 so that the incoming air is encouraged to follow a helical path around the interior of the upstream cyclone.

A shroud 225 is located inwardly of the cylindrical wall 224 of the upstream cyclone 222. The shroud 225 comprises a cylindrical wall having a plurality of through-holes. The shroud 225 provides a communication path between the upstream cyclone 222 and a downstream cyclone assembly 226.

The downstream cyclone assembly 226 comprises a plurality of downstream cyclones 227 arranged in parallel. In this embodiment, seven downstream cyclones 227 are provided. Each downstream cyclone 227 is in communication with a downstream collector 228 forming part of the collecting chamber 220. The downstream collector 228 has a collector wall 229 located inwardly of the shroud 225. Each of the downstream cyclones 227 has a diameter smaller than that of the upstream cyclone 222 and so are able to separate smaller particles of dirt and dust from the partially-cleaned airflow than the upstream cyclone 222. Separated dirt and dust exits the downstream cyclones 227 and passes into the downstream collector 228.

Cleaned air then flows back up through the downstream cyclones 227 and enters a duct 230. The cleaned air then passes from the duct 230 sequentially through a pre-motor filter 231, the motor and fan unit, and a post-motor filter 232 before being exhausted from the vacuum cleaner 210 through the outlet ports 217.

Figure 20:
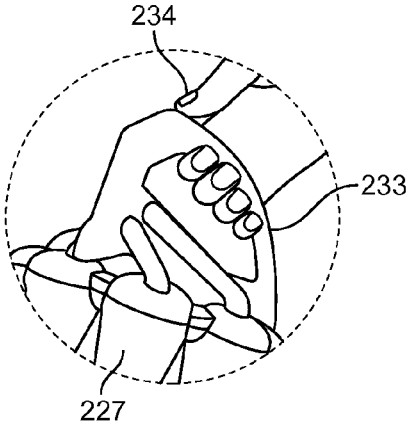
FIG. 20 is an enlarged view of part of FIG. 19.

A handle 233 is located over the separating apparatus 218 and is arranged to allow a user to carry the vacuum cleaner 210. When the separating apparatus 218 is released from the main body 211, as is shown in FIG. 20, the handle 233 may also be used to carry the separating apparatus alone. With reference to FIG. 20, a user-operable button 234 is located on the separating apparatus 218 at the upper end portion of the handle 233. By depressing the button 234, the user releases a catch holding the separating apparatus 218 to the main body 211. The user can then place the separating apparatus 218 over a suitable dirt and dust receptacle such as a dustbin for emptying of dirt and dust that has been collected in the collecting chamber 220.

Figure 21:
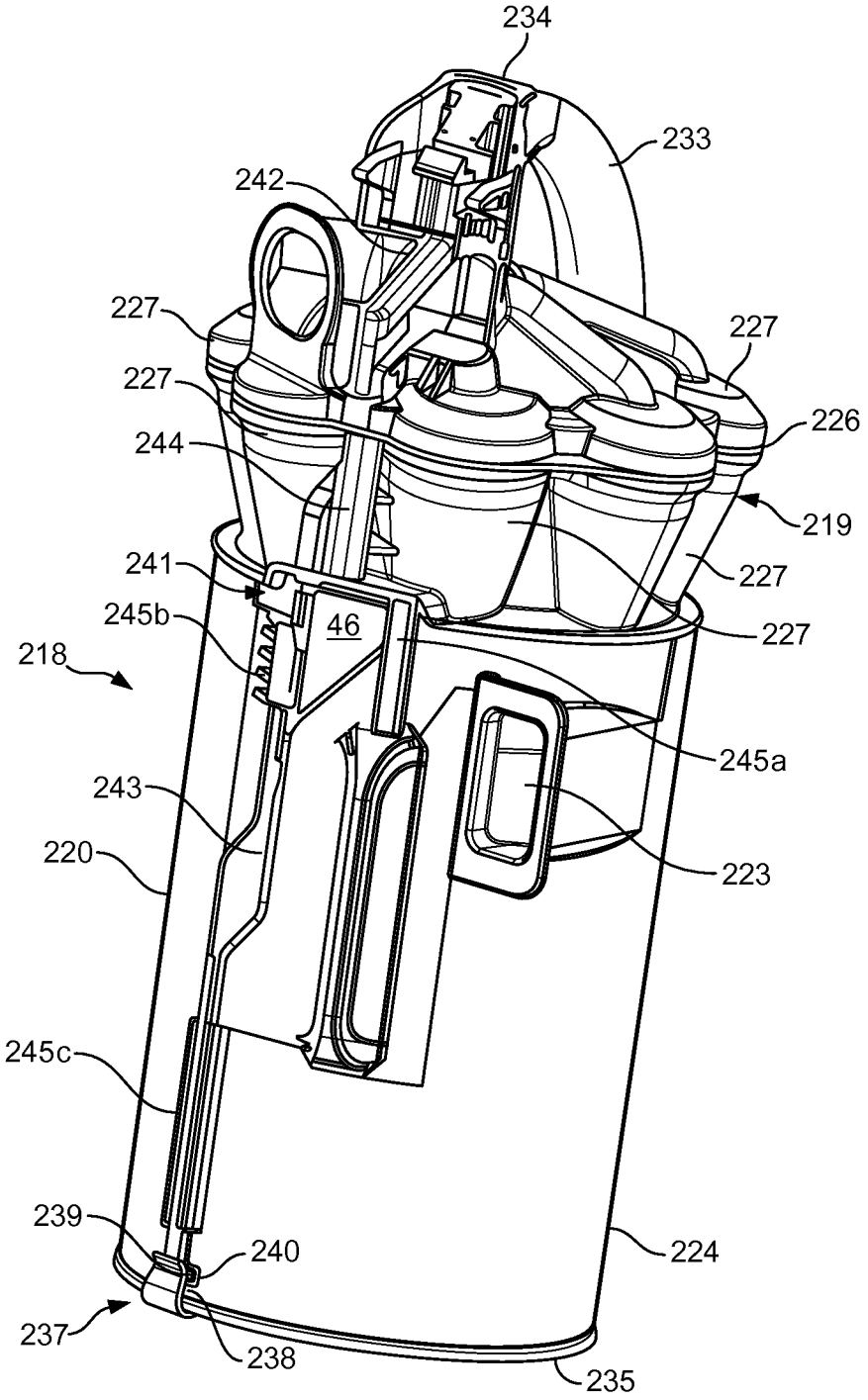
FIGS. 21 and 22 are perspective views of a cyclonic separating apparatus from the upright vacuum cleaner in FIG. 19.
Figure 22:
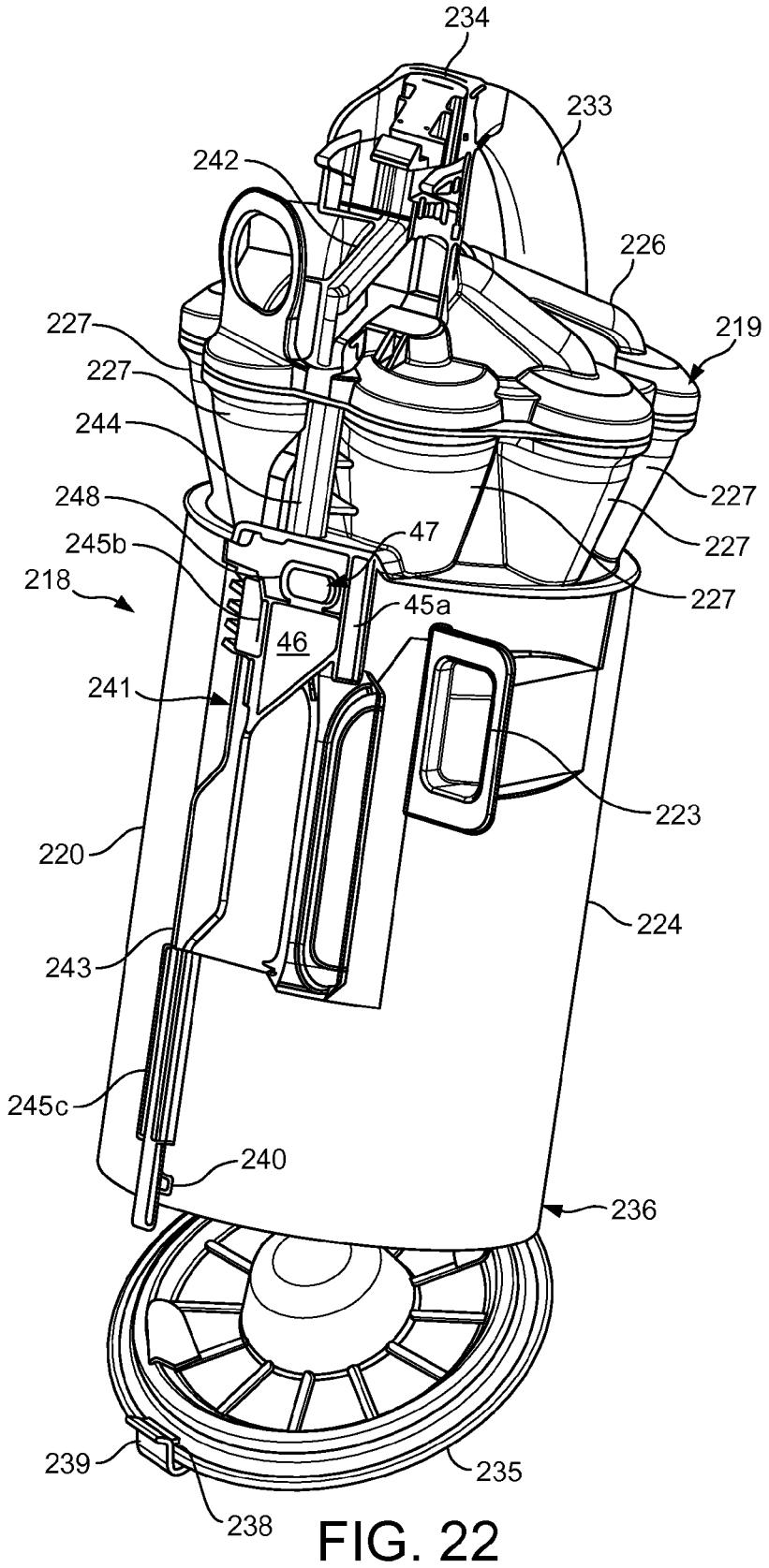

Referring now to FIGS. 21 and 22, the collecting chamber 220 includes a closure member which, in this embodiment, comprises the base 235 of the collecting chamber. The base 235 is pivotably mounted on the lower end of the cylindrical side wall 224 by means of a hinge 236. The base 235 is retained in a closed position (as shown in FIG. 21) by means of a first catch 237. The first catch 237 includes a lug 238 and a flange 239. In this embodiment, the lug 238 and flange 239 are integral with the base 235 and extend from it. The lug 238 is inwardly directed and is received by a cooperating groove 240 formed in the external surface of the cylindrical side wall 224. The lug 238 is formed from a resilient material which biases the lug into the groove 240 when the base 235 is in the closed position. The flange 239 extends outwardly and upwardly from the lug 238.

The separating apparatus 218 further includes first releasing means in the form of an actuator 241. The actuator 241 comprises a first push member 242 and a second push member 243 which are generally in the form of elongated rods. The first push member 242 is arranged at the upper end of the rear of the separating apparatus 218, adjacent some of the downstream cyclones 227. The uppermost end portion of the first push member 242 includes the user-operable button 234 at the upper end of the handle 233. The button 234 is biased upwardly by a spring (not shown). The first push member 242 is arranged to be slideably movable by depression of the button 234 against the bias of the spring. The first push member 242 is supported by a guide 244 that constrains the first push member to slide in a generally vertical direction, namely towards the base 235 of the collecting chamber 220.

The second push member 243 is arranged on the lower portion of the rear of the separating apparatus 218, adjacent the collecting chamber 220. The second push member 243 is supported by a plurality of guides 245*a*, 245*b*, 245*c* that constrain the second push member 243 also to slide in a generally vertical direction. An upper portion of the second push member 243 comprises a cover 246 which, in this embodiment, takes the form of a triangular-shaped member which extends to one side of the elongate rod. A lower portion of the second push member has a thick dog-leg shape for increased robustness. The second push member 243 is not biased in any direction. The lower end portion of the second push member 243 is arranged to abut the flange 239 of the first catch 237. In this embodiment, the second push member 243 is interposed between the flange 237 and the wall 224 of the collecting chamber 220.

When a user decides to empty the collecting chamber 220 of the separating apparatus 218, he pushes the button 234 against the force of the spring, as shown in FIG. 20. The guide 244 constrains the first push member 242 to slide downwardly towards the collecting chamber 220 into a lower second position. The lower end of the first push member 242 normally abuts the upper end of the second push member 243, and so the action of pushing down the first push member also urges the second push member downwardly into a lower second position. The bottom end of the second push member 243 is forced against the flange 239 of the first catch 237 and applies an outwardly-directed force to it. The lug 238, being integral with the flange 239, also experiences an outwardly-directed force, which force urges the lug 238 away from the groove 240. Thus, the first catch 237 holding the base 235 to the cylindrical side wall 224 of the collecting chamber 220 is released. The action of the second push member 243 against the flange 239 forces the base 235 to swing open on its hinge 236, as is shown in FIG. 22. The dirt and dust collected in the collecting chamber 220 can thus be emptied conveniently and efficiently. The upstream cyclone 22 and the downstream collector 28 are emptied simultaneously during this process.

When the user releases pressure on the button 234, the spring urges the button and the first push member 242 upwards into their original positions. The second push member 243 is not biased and so remains in its lower second position as shown in FIG. 21. In moving the second push member 243 from its original position to its lower position, the cover 246 associated with the second push member slides downwardly to reveal a second catch 247, which was concealed behind the cover. This second catch 247 holds the collecting chamber 220 to the separator 219. Activation of this second catch 247 therefore enables the collecting chamber 220 to be removed from the separator 219.

Instead of the second catch 247, the separating apparatus 218 of FIGS. 19 to 22 may alternatively be configured so that the user-operable button 234 also acts to release the collecting chamber 220 from the separator 219. A schematic illustration of such an arrangement is shown in FIGS. 23*a*-23*d* in which the same reference numerals are used.

Figure 23A:
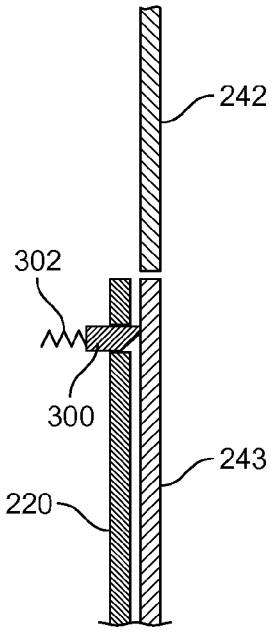
FIG. 23*a* to FIG. 23*d* are schematic views of a mechanism associated with the cyclonic separating apparatus of FIGS. 21 and 22.

In FIG. 23*a*, the collecting chamber 220 is attached to the separator and the first push member is in a deactivated position. In this position, a slidable lug 300 that forms part of the collecting chamber is retained in a recessed position behind the second push member 243. In this condition the base 35 is in the position as shown in FIG. 21.

Figure 23B:
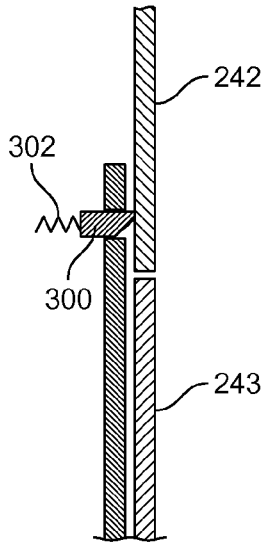

In FIG. 23*b*, a user has depressed the button 243 which slides the first push member 242 in a downwards direction and also, therefore, the second push member 243 which opens the base 235. This position corresponds to the position of the base 235 shown in FIG. 22. In this position, the lug 300 is still retained in a recessed position by the presence of the first push member 242.

Figure 23C:
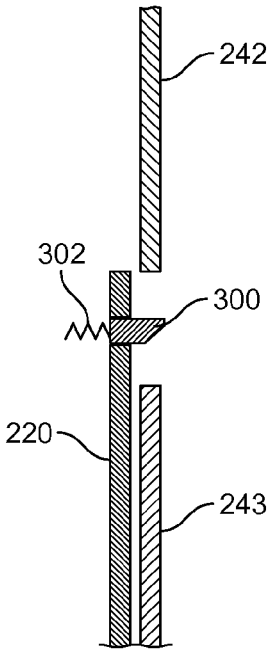

In FIG. 23*c*, the first push member has returned to its original position which allows the lug 300 to deploy from the collecting chamber by virtue of the biasing means 302 which, in this arrangement, is in the form of a spring 302.

Figure 23D:
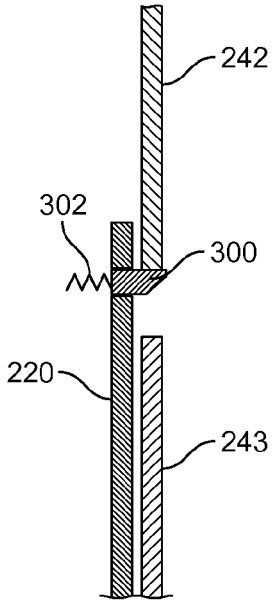

FIG. 23*d* shows the movement of the first push member 242 during a second actuation. As can be seen, the lower end of the first push member 242 engages the lug 300 after movement of a short distance. Further downwards movement of the first push member 242 bears against the lug 300 and, in turn, against the collecting chamber 220 itself and so urges the collecting chamber 220 to disengage from the separator 219.

It will therefore be appreciated that the bin opening and bin release arrangement of the vacuum cleaner in FIGS. 19 to 23 functions similarly to the arrangement described in FIGS. 1 to 9 in that a single user-operable button is operable to perform two functions sequentially: a first press of the button 234 opens the base 235 of the dirt collecting chamber 220 and, once the base 235 is open, a second press of the button 234 releases the collecting chamber 220 from the separator 219.

The invention claimed is:

1. A cleaning appliance comprising a main body and a separating apparatus including a dirt collector having a base that is openable to allow the dirt collector to be emptied, wherein the cleaning appliance includes an actuator that is operable sequentially such that, during a first operation, the actuator causes the base to be opened and, during a second operation, the actuator causes the dirt collector to disengage from the separating apparatus.

2. The cleaning appliance of claim 1, wherein the base of the dirt collector is openable when the separating apparatus is coupled to the main body.

3. The cleaning appliance of claim 1, wherein the actuator is a user-operable button.

4. The cleaning appliance of claim 1, wherein the actuator includes a linkage member which, during the first operation, actuates a push rod that is engagable with the base.

5. The cleaning appliance of claim 4, wherein the linkage member is further operable, during the second operation, to engage a release member on the main body for retaining a lug on the dirt collector.

6. The cleaning appliance of claim 5, wherein the linkage member is rotatable between a first angular position in which the linkage member engages with the push rod and a second position in which the linking member engages with the release member.

7. The cleaning appliance of claim 6, wherein the linkage member rotates from the first to the second position after completion of the first operation of the actuator.

8. The cleaning appliance of claim 7, wherein the linkage member rotates from the first to the second position during the second operation of the actuator.

9. The cleaning appliance of claim 6, wherein the linkage member is biased into the second angular position.

10. The cleaning appliance of claim 9, wherein the pushrod includes a lip to retain the linkage member in the first angular position during the first operation of the actuator.

11. The cleaning appliance of claim 5, wherein during the second operation the release member is moved out of engagement with the lug on the dirt collector so as to allow the dirt collector to be disengaged from the separating apparatus.

12. The cleaning appliance of claim 11, wherein the release member includes a projection that, during the second operation, moves in synchronisation with the release member to push the lug away from the main body therefore to present the dirt collector for a user to remove from the separating apparatus.

13. The cleaning appliance of claim 1, wherein the main body includes a spine against which the dirt collector abuts when the separating apparatus is coupled to the main body.

14. The cleaning appliance of claim 13, wherein the actuator is slidably mounted to the spine.

15. The cleaning appliance of claim 1, wherein the actuator is arranged to be accessible from either side of the vacuum cleaner.

16. The cleaning appliance of claim 1, wherein the separating apparatus includes a cyclonic separator.

17. The cleaning appliance of claim 1, wherein the base of the dirt collector is openable only when the separating apparatus is decoupled from the main body.

18. The cleaning appliance of claim 17, wherein the actuator is also operable to release the separating apparatus from the main body.

19. The cleaning appliance of claim 17, wherein the actuator for opening the base and releasing the dirt collector from the separating apparatus is located on the separating apparatus.

* * * * *